US009750123B1

(12) United States Patent
Heath et al.

(10) Patent No.: US 9,750,123 B1
(45) Date of Patent: Aug. 29, 2017

(54) CUSTOMIZABLE RADIO FREQUENCY (RF) FOR USE IN PARTICLE ACCELERATOR APPLICATIONS

(71) Applicant: The Boeing Company, Chicago, IL (US)

(72) Inventors: Bryant G. Heath, Salt Lake City, UT (US); Henry F. Moeller, Jr., Kaysville, UT (US); David B. Olsen, Layton, UT (US); Dominic J. Kobbeman, Ogden, UT (US); Michael K. Strahan, Ogden, UT (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/225,705

(22) Filed: Aug. 1, 2016

(51) Int. Cl.
*H05H 7/22* (2006.01)

(52) U.S. Cl.
CPC ..... *H05H 7/22* (2013.01); *H05H 2007/222* (2013.01)

(58) Field of Classification Search
None
See application file for complete search history.

(56) References Cited

U.S. PATENT DOCUMENTS 7,112,924 B2 * 9/2006 Hanna ..... H05H 7/18 315/5.41
9,119,281 B2 * 8/2015 Chen ..... H05H 7/02
2012/0326636 A1 * 12/2012 Eaton ..... H05H 7/02 315/501
2013/0267098 A1 * 10/2013 Maeda ..... C23C 16/507 438/710
2014/0270086 A1 * 9/2014 Krasnykh ..... H05G 2/00 378/124

OTHER PUBLICATIONS

Argonne National Laboratories, "The Linac Modulator", Oct. 21, 2008, available via the internet at www1.aps.anl.gov/files/download/RF/Presentations-Lectures-Training/Cross-Training/Cours_Presentation%203-7-08.pdf (last visited Aug. 1, 2016).

(Continued)

*Primary Examiner* — Douglas W Owens
*Assistant Examiner* — James H Cho
(74) *Attorney, Agent, or Firm* — McDonnell Boehnen Hulbert & Berghoff LLP

(57) ABSTRACT

Methods and apparatus are provided for generating an amplified pulsed radio frequency (RF) signal used by a particle accelerator. The particle accelerator can generate an attenuation profile. The particle accelerator can determine a waveform and a duration for a pulsed RF signal based on the attenuation profile. The particle accelerator can generate the pulsed RF signal having the waveform and the duration. The particle accelerator can generate an amplified pulsed RF signal using one or more amplifiers of the particle accelerator. The amplifiers can include a pulse forming network (PFN), where the PFN can include a plurality of stages and a plurality of PFN switches, and where PFN stage can include one or more capacitors and inductors. The PFN switches can control the PFN stages. The duration of the amplified pulsed RF signal can be based on settings of the plurality of PFN switches.

20 Claims, 13 Drawing Sheets

(56) References Cited

OTHER PUBLICATIONS

Cern, "How an Accelerator Works", Oct. 24, 2015, available via the Internet at web.archive.org/web/20151024015723/http://home.cern/about/how-accelerator-works (last visited Aug. 1, 2016).
A. Nassiri, "RF Systems for Accelerators", Jun. 14, 2010, available via the Internet at uspas.fnal.gov/materials/10MIT/Lecture17.pdf (last visited Aug. 1, 2016).

* cited by examiner

CUSTOMIZABLE RADIO FREQUENCY (RF) FOR USE IN PARTICLE ACCELERATOR APPLICATIONS

GOVERNMENT LICENSE RIGHTS

This invention was made with government support under contract numbers FA8204-12-D-7001-0001 and FA8204-12-D-7001-0049 awarded by the Department of Defense. The government has certain rights in this invention.

FIELD

The present disclosure generally relates to particle accelerators, and more particularly to methods and apparatus for generating customized pulses using electron particle accelerators.

BACKGROUND

Unless otherwise indicated herein, the materials described in this section are not prior art to the claims in this application and are not admitted to be prior art by inclusion in this section.

A typical electron linear accelerator consists of an injector or electron gun, a pre-buncher, a focusing lens, acceleration guides, and an optional target. In the injector, electrons are boiled off the cathode and accelerated toward an annular beam-focusing anode that forms electron bunches. The pre-buncher compacts the electron bunches from the injector. Steering coils in the focusing lens narrow the beam. A set of tuned microwave cavities forms the acceleration guides that are driven by an oscillating electric field. The oscillating electric field can be amplified radio frequency (RF) energy, typically having wave forms or wave shapes of constant-amplitude sine-waves. Then the additional energy from the field accelerates the electrons and increases the electrons' relative mass until they reach the desired energy. Electrons reaching the desired energy are then provided as pulses of electrons as outputs, often provided at a target area of the electron linear accelerator.

This approach has the drawbacks of enabling only a limited amount of customization of the pulses of electrons. Electrical pulses generated by pulse forming networks of current electron linear accelerators typically have the same pulse duration, leading to wasted energy and increased electrical stress when the pulse forming networks are used to generating output pulses of electrons having shorter pulse durations than the pulse duration of electrical pulses from the pulse forming network. Also, current electron linear accelerators require the use of complicated procedures to produce output pulses of having a particular waveform. Further, certain output waveforms are unattainable when using constant amplitude RF signals to provide RF energy to accelerate the electrons.

SUMMARY

In one aspect, a particle accelerator is provided. The particle accelerator includes one or more computer processors, data storage, an arbitrary waveform generator, and one or more amplifiers. The data storage stores instructions that, upon execution by the one or more computer processors, cause the particle accelerator to perform functions. The functions include: generating an attenuation profile. The arbitrary waveform generator is for determining a waveform and a duration for a pulsed RF signal based on the attenuation profile; and generating the pulsed RF signal having the waveform and the duration. The one or more amplifiers include a pulse forming network (PFN). The pulse forming network includes a plurality of PFN stages, where a PFN stage of the plurality of PFN stages includes one or more capacitors and one or more inductors, and a plurality of PFN switches for controlling the plurality of PFN stages. The PFN is for generating an amplified pulsed RF signal based on the pulsed RF signal, where the duration of the amplified pulsed RF signal is based on one or more settings of the plurality of PFN switches.

In another aspect, a method for generating an amplified pulsed radio frequency signal is provided. An attenuation profile is generated for a particle accelerator. The particle accelerator determines a waveform and a duration for a pulsed RF signal based on the attenuation profile. The particle accelerator generates the pulsed RF signal having the waveform and the duration. The particle accelerator generates an amplified pulsed RF signal using one or more amplifiers of the particle accelerator. The one or more amplifiers include a pulse forming network, where the PFN includes a plurality of stages and a plurality of PFN switches. A PFN stage of the plurality of PFN stages includes one or more capacitors and one or more inductors. The plurality of PFN switches controls the plurality of PFN stages, where the duration of the amplified pulsed RF signal is based on one or more settings of the plurality of PFN switches.

The features, functions, and advantages that have been discussed can be achieved independently in various embodiments or may be combined in yet other embodiments further details of which can be seen with reference to the following description and drawings.

BRIEF DESCRIPTION OF THE FIGURES

Various examples of particular embodiments are described herein with reference to the following figures, wherein like numerals denote like entities, in which.

DETAILED DESCRIPTION

Figure 1:
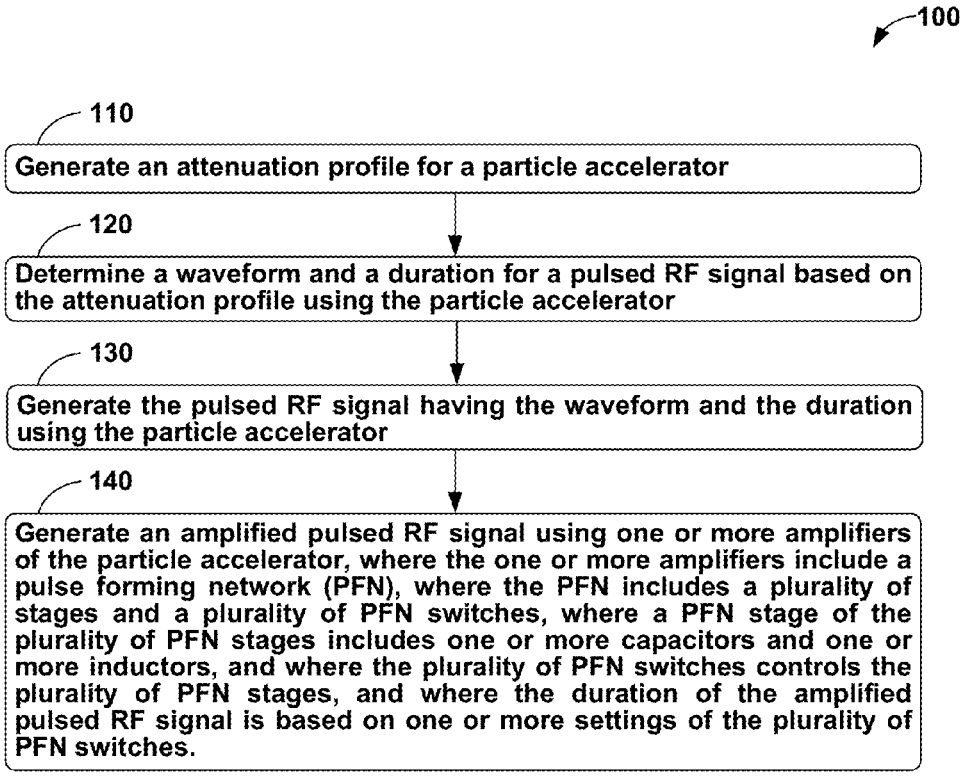
FIG. 1 is a flowchart of a method, in accordance with an example embodiment.

This disclosure relates to enabling customizable particle accelerator performance by enabling customization of particle accelerator output. A particle accelerator, such as an electron linear accelerator, speeds up a beam of subatomic particles, such as electrons or protons, by transferring energy to the subatomic particles.

For example, a particle accelerator can include of an injector or electron gun to generate electrons, a pre-buncher, a focusing lens, and accelerating guides (AGs) for generating and accelerating a beam of electrons, and an optional Bremsstrahlung target, or region for slowing down the electrons. In the injector, electrons are emitted by a cathode and accelerated toward an annular beam-focusing anode that forms electron bunches. The pre-buncher compacts the electron bunches from the injector into the beam of electrons. The focusing lens can include steering coils to narrow the beam of electrons.

The accelerating guides include a set of tuned microwave cavities that can store an oscillating electric field that is outputted by one or more klystrons. A klystron is a specialized linear-beam vacuum tube that can emit the oscillating electric field. The oscillating electric field can add energy to, and thus accelerate, the beam of electrons until the electrons' velocities approach the speed of light. The beam of electrons can leave the accelerating guides as an accelerated beam to reach a target area. In some examples, two or more klystrons can be used in a particle accelerator where each klystron powers a separate section of the accelerating guides.

The klystron(s) can take two inputs to generate the oscillating electric field: (1) input RF signals, which can be provided by an RF generator that has been amplified by a pulse amplifier, and (2) a pulsed voltage supply, which can be provided by a pulse forming network (PFN). The pulse forming network can store and release a large amount electrical energy in a form of a square pulse. The pulsed voltage supply can add power to the input RF signals and so generate the amplified oscillating electric field. To customize klystron output, both the input RF signals and the pulsed voltage supply can be modified based on user-specified controls.

The input RF signals can be customized using an arbitrary waveform generator (ARB). The arbitrary waveform generator can generate a waveform that specifies attenuation of RF waves generated by a RF generator. The waveform generated by the arbitrary waveform generator can be determined based on a user-generated attenuation profile. The attenuated RF waves can then be amplified by the pulse amplifier to generate customized input RF signals. These customized input RF signals can be used to generate output pulses of the particle accelerator of having a customized waveform that is based on the customized input RF signals. For example, an output pulse having a waveform of a short duration, high amplitude pulse immediately followed by a long duration, lower amplitude pulse can be generated using customized input RF signals.

The pulsed voltage supply can be customized by use of a switchable pulse forming network. User-controllable switches in the switchable pulse forming network can control how much electrical energy is stored by the switchable pulse forming network, and thereby allow user specification of the duration of the pulsed voltage supply. In particular, the switchable pulse forming network can include a number of stages, each stage storing and releasing electrical energy, where each stage is controlled by a switch that enables or disables current flow for the stage. Thus, the switches of the switchable pulse forming network can be used to generate electrical pulses of two or more different pulse durations; e.g., when relatively short pulses are to be provided, only a portion of the pulse forming network can be enabled for current flow and when relatively long pulses are to be provided, the entire pulse forming network can be enabled for current flow.

By enabling user-specified controls to modify the input RF signals and the pulsed voltage supply of a klystron, the resulting oscillating electric field output by the klystron can be controlled by use of software to readily produce a variety of wave shapes as outputs of the particle accelerator. The software can enable rapid customization of the input RF signals and a pulsed voltage supply and thus alter the make-up of the accelerator output wave shape. The hereindescribed techniques and apparatus enable reduction of tuning time of particle accelerators required to produce these output wave shapes, thus allow for more experiment test time and higher customer satisfaction. In addition, not having to tune the accelerator using non-ideal settings to produce such wave shapes would reduce the frequency of repairs and the cost of added maintenance.

As the oscillating electric field controls the energy imparted to a beam of electrons generated by a particle accelerator, controlling the oscillating electric field effectively controls the output of the particle accelerator. Such controls enable generation of customized pulses of energy by the particle accelerator. As one application, the customized pulses of energy can be used to model more radiation environments than standard pulses of energy, thereby increasing the flexibility of the particle accelerator in testing device operation in these radiation environments. For example, customized input RF signals and input electron beams can be used to generate a combined pulse with a short duration, high amplitude pulse immediately followed by a long duration, lower amplitude pulse for simulating a particular radiation environment.

Further, switchable pulse forming networks can provide pulses of variable durations. For example, if a shortened duration pulse is to be generated, some stages of the switchable pulse forming network can be switched off, reducing the amount of electrical energy provided while maintaining the same output voltage amplitude. Other applications of the customized and/or variable-duration pulses of energy by the particle accelerator are possible as well.

Use of a switchable pulse forming network can lead to minimizing energy being applied to components of a particle accelerator. Based on the settings of switches in the switchable pulse forming network, relatively short (e.g., 10 μs) pulses can be generated. Shorter pulses lead to reduced energy and correspondingly less electrical stress compared to relatively long (e.g., 100 μs) pulses. Thus, shorter pulses can reduce the wear-and-tear on klystrons and the switchable pulse forming network of the particle accelerator. Thus, the use of a switchable pulse forming network can reduce power usage, energy costs, downtime due to repairs, and maintenance expenditures to operate the particle accelerator.

Operational Methods

FIG. 1 is a flowchart of method 100, in accordance with an example embodiment. For example, method 100 can be used to generate an amplified pulsed RF signal. Method 100 can be carried out by a particle accelerator. In some embodiments, the particle accelerator includes a linear accelerator, such as particle accelerator 200 discussed below in the context of at least FIGS. 2-18.

At block 110, the particle accelerator can generate an attenuation profile, such as discussed in the context of at least FIGS. 2 and 6-14.

At block 120, the particle accelerator can determine a waveform and a duration for a pulsed RF signal based on the attenuation profile, such as discussed in the context of at least FIGS. 2 and 6-14.

In some embodiments, the particle accelerator can further include an arbitrary waveform generator. Then, determining the waveform and the duration for the pulsed RF signal based on an attenuation profile can include determining the waveform and the duration for the pulsed RF signal using the arbitrary waveform generator, such as discussed in the context of at least FIGS. 2 and 6-14. In particular of these embodiments, determining the waveform and the duration for the pulsed RF signal using the ARB includes determining one or more amplitudes of the pulsed RF signal using the ARB, such as discussed in the context of at least FIGS. 6 and 8.

At block 130, the particle accelerator can generate the pulsed RF signal having the waveform and the duration, such as discussed in the context of at least FIGS. 2 and 4-14.

At block 140, the particle accelerator can generate an amplified pulsed RF signal using one or more amplifiers of the particle accelerator. The one or more amplifiers can include a pulse forming network that can include a plurality of stages and a plurality of PFN switches. A PFN stage of the plurality of PFN stages can include one or more capacitors and one or more inductors. The plurality of PFN switches can control the plurality of PFN stages and the duration of the amplified pulsed RF signal can be based on one or more settings of the plurality of PFN switches, such as discussed in the context of at least FIGS. 2, 4, 7, 8, and 15-17.

In some embodiments, the particle accelerator can include an RF generator and a voltage attenuator. In these embodiments, generating the amplified pulsed RF signal using one or more amplifiers of the particle accelerator can include: generating a constant amplitude waveform using the RF generator; generating the pulsed RF signal by attenuating the constant amplitude waveform according to the waveform and the duration using the voltage attenuator; and providing the pulsed RF signal as an input to the one or more amplifiers using the voltage attenuator, such as discussed in the context of at least FIGS. 2 and 8.

In some embodiments, the particle accelerator can further include an accelerating guide. Then, method 100 can additionally include controlling one or more charged particles traveling along the accelerating guide using the amplified pulsed RF signal, such as discussed in the context of at least FIGS. 2-6.

In other embodiments, method 100 can additionally include: generating an output of the particle accelerator based on the amplified pulsed RF signal, where the output including a plurality of pulses with each pulse having a pulse duration, such as discussed in the context of at least FIGS. 2 and 4-14. In particular of these embodiments, the output of the particle accelerator can include a first pulse and a second pulse, where the pulse duration of the first pulse can be relatively short, and where the pulse duration of the second pulse can be relatively long, such as discussed in the context of at least FIGS. 11 and 12.

Customizable Particle Accelerators

Figure 2:
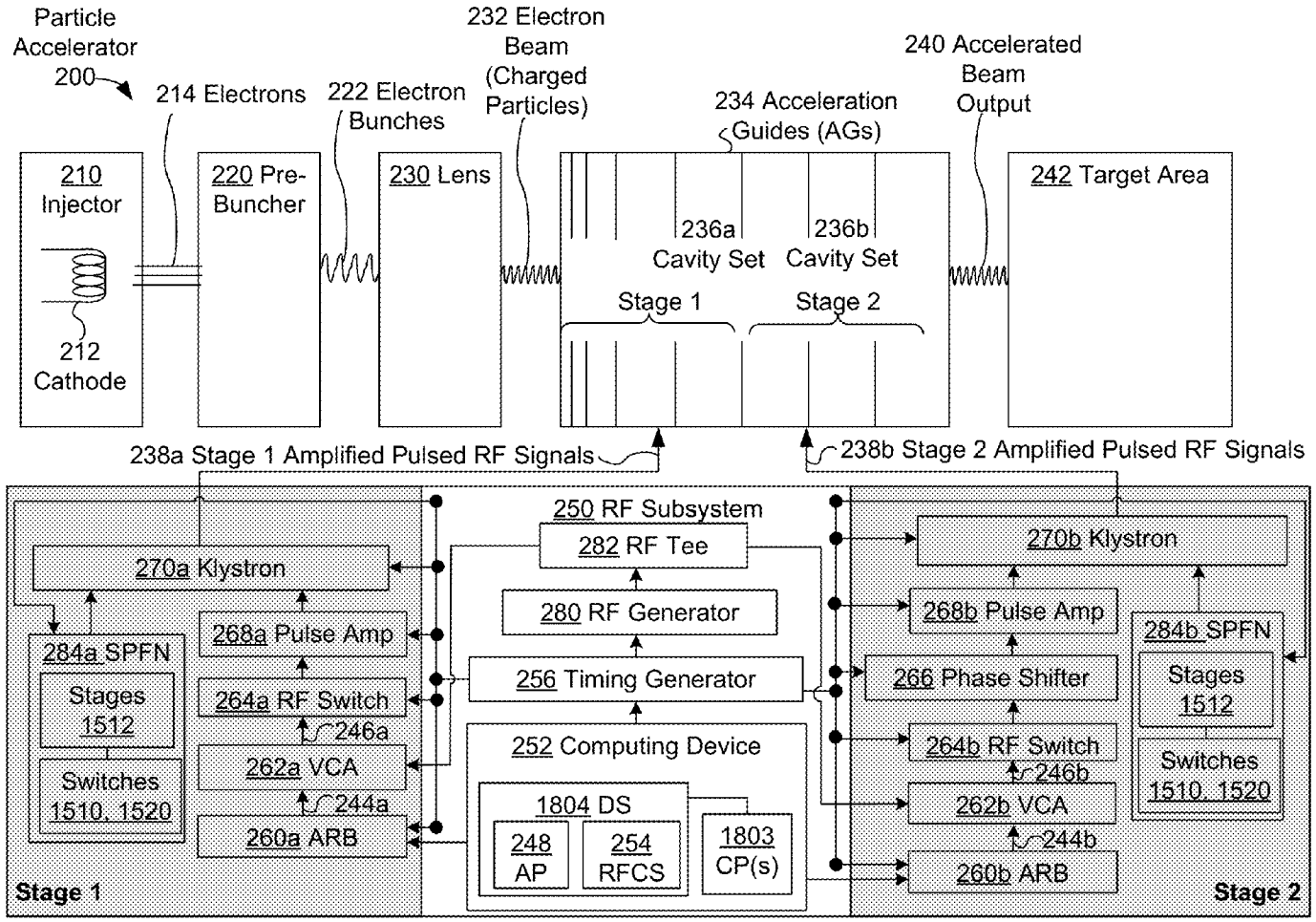
FIG. 2 is a block diagram of a particle accelerator, in accordance with an example embodiment.

FIG. 2 is a block diagram of particle accelerator 200, in accordance with an example embodiment. In some embodiments, particle accelerator 200 can include a linear accelerator. In particular, particle accelerator 200 can include an electron linear accelerator. Particle accelerator 200 includes injector 210, pre-bundler 220, lens 230, accelerating guide 234, target area 242, and RF subsystem 250. Particle accelerator 200 can accelerate charged particles, such as electrons or protons, to generate accelerated particles in accelerated beam output 240.

Injector 210 can produce, accelerate, and focus charged particles, such as electrons 214. Injector 210 can include cathode 212 to produce electrons. In some embodiments, cathode 212 can be part of an electron gun that has a beam focusing anode to assist in focusing electrons 214 into a beam.

Pre-buncher 220 can group charged particles into bunches, such as electrons 214 into electron bunches 222. Pre-buncher 220 can have a tuned cavity and an electron drift tube supplied with a RF field. Electrons 214 are either accelerated or decelerated by pre-buncher 220 according to the relative phase of the RF field. As a result, electrons 214 can be longitudinally compressed into numerous well-defined electron bunches 222. The bunching action can be described by considering the RF field as an oscillating field in the form of a fixed sine wave at any instant of time. When the period of the oscillating field is short with respect to pulse width of the oscillating field, electrons in pre-buncher 220 can be assumed to have a uniform population distribution. Also, electrons in pre-buncher 220 travel at the same speed as the oscillating field. As a result, the fixed sine wave traveling with the electrons imparts energy to the electrons. Electrons in pre-buncher 220 with slightly less energy than the oscillating field contains will be accelerated and those with more energy will be decelerated. The result is a bunching of electrons near the crest of each sine wave into electron bunches 222.

Lens 230 can focus charged particles into a beam, such as electron bunches 222 into electron beam 232, which can be a beam of charged particles. As electrons 214 pass from injector 210 to pre-buncher 220 and as electron bunches 222 are formed, electron bunches 222 can include a high density of electrons. This high density of electrons can produce significant space charge effects and mutually repelling electrons of electron bunches 222 tend to diverge. Lens 230 can be used to reduce the divergence of electrons in electron bunches 222. Lens 230 can include an annular electromagnet that produces a magnetic field parallel to electron bunches 222. The electrons in electron bunches 222 can spiral around the magnetic field line as they travel through lens 230. In some embodiments, the magnetic field can be adjusted during machine operation to maximize electron or charged particle transmission between injector 210 and accelerating guide 234.

Accelerating guide 234 can accelerate charged particles, such as electrons in electron beam 232, to form accelerated beam output 240. Accelerating guide 234 can have a set of microwave cavities including cavity sets 236*a* and 236*b* which are resonant to a primary operating frequency of particle accelerator 200. A traveling electric field in accelerating guide 234 can be created by coupling amplified pulses of RF energy provided as amplified pulsed RF signals 238*a*, 238*b* of RF subsystem 250 to accelerating guide 234. Electrons in electron beam 232 can be accelerated by absorbing energy from the pulses of RF energy in amplified pulsed RF signals 238*a*, 238*b* of RF subsystem 250. Thus, changes in amplified pulsed RF signals 238*a*, 238*b* can affect acceleration of electrons in accelerated beam output 240.

The traveling electric field within separate cavities of accelerating guide 234 can be synchronized with electron bunches of electron beam 232, so that the electric field accelerates the first bunch while it is in the first cavity of accelerating guide 234. By the time the first bunch of electrons in electron beam 232 reaches the second cavity of accelerating guide 234, the polarity of the electric field can change so that the second cavity accelerates the electrons. Meanwhile, the polarity of the electric field in the first cavity of accelerating guide 234 will have been reversed and will decelerate any electrons in the first cavity. The bunches of electrons in electron beam 232 are spaced so that the first bunch enters the third cavity of accelerating guide 234 as the second bunch of electrons in electron beam 232 enters the first cavity of accelerating guide 234 as polarity of the electric field has reversed again.

As indicated in FIG. 2, not all cavities within accelerating guide 234 are equal in length. In some examples, as electron beam 232 enters accelerating guide 234, electrons in electron beam 232 can be traveling at velocities of about half the speed of light. Each successive cavity of accelerating guide 234 can apply accelerating forces upon the electrons of electron beam 232 until the velocities of the electrons approach the speed of light. At this point, additional energy from the electric field in accelerating guide 234 adds to the relative mass of the electrons and so the velocity of the electrons remains constant. To synchronize electron bunches in electron beam 232 with the RF field provided by RF subsystem 250, compensation can be made for increasing electron velocity by having, the dimensions of each successive cavity of accelerating guide 234 are proportional to electrons' mean speed in that cavity.

Several additional factors affect the electron beam as it travels through accelerating guide 234. Changes in temperature can alter the physical dimensions of cavities of accelerating guide 234 and loading discs. Even though these changes are small, these changes can affect the operating electromagnetic mode within these accelerating guides which determines the maximum energy coupling. The earth's magnetic field and any other stray magnetic fields can also affect the electrons along their path. In some embodiments, temperature within accelerating guide 234 can be controlled with water in a closed-loop compensating network that includes a circulating pump, heat exchanger, and mixing valve to maintain a water temperature within ½ degree Fahrenheit. Magnetic fields within accelerating guide 234 can be controlled with the aid of steering magnets (not shown in FIG. 2) that can apply compensating magnetic fields. These steering magnets can cancel any external stray magnetic fields and correct for minor misalignments.

Electrons in accelerated beam output 240 can leave accelerating guide 234 to reach target area 242. For example, electron bunches in accelerated beam output 240 can be propagated through a drift tube and thin metal foil exit window in target area 242. The contents of target area 242 can depend on the application of particle accelerator 200. In some examples, target area 242 can include devices related to radiation part testing applications. In other examples, target area 242 can include a bremsstrahlung target for decelerating electrons in accelerated beam output 240 that can be placed outside the exit window. In still other examples, target area 242 can include a set of scattering foils of varying thickness to diffuse and attenuate accelerated beam output 240. In some embodiments, a duration that electrons of accelerated beam output 240 are injected into target area 242 can have a fixed maximum value (e.g., 50 ns, 100 μs).

FIG. 2 includes a block diagram of an RF subsystem 250 of particle accelerator 200, in accordance with an example embodiment. RF subsystem 250 can include computing device 252, timing generator 256, stage 1, stage 2, RF generator 280, RF tee 282, and switchable pulse forming networks (SPFNs) (switchable PFNs) 284*a*, 284*b*.

Stages 1 and 2 are illustrated in FIG. 2 using gray boxes within RF subsystem 250 respectively labeled as "Stage 1" and "Stage 2". FIG. 2 indicates that stages 1 and 2 of RF subsystem 250 can include respective arbitrary waveform generators (ARBs) 260*a*, 260*b*, voltage controlled attenuators (VCAs) 262*a*, 262*b*, RF switches 264*a*, 264*b*, pulse amplifiers 268*a*, 268*b*, and klystrons 270*a*, 270*b*. Stage 2 can also include phase shifter 266. In some embodiments, RF subsystem 250 can have one stage or more than two stages.

Figure 18:
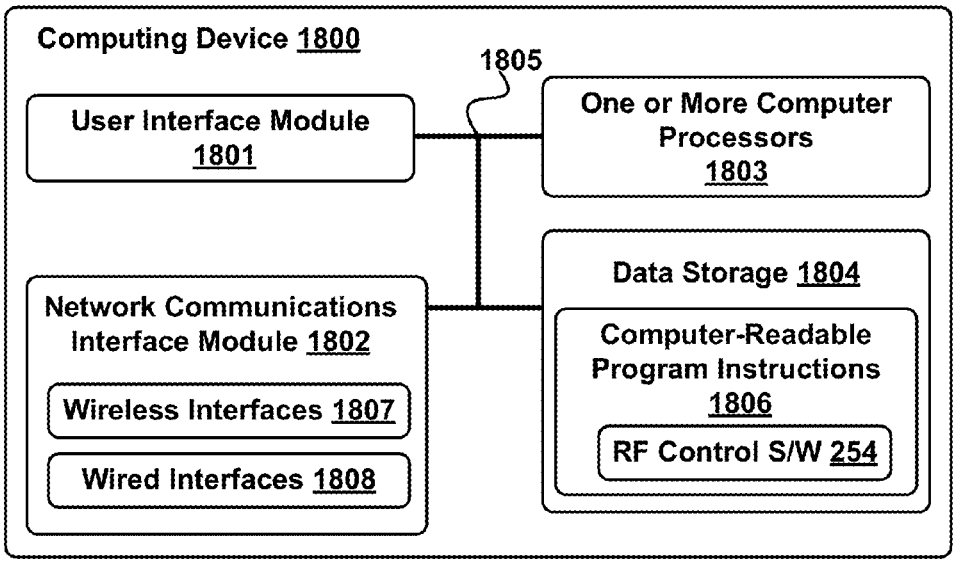
FIG. 18 is a block diagram of a computing device, in accordance with an example embodiment.

Computing device 252 can include one or computer processors (CPs) 1803 and data storage (DS) 1804, which are discussed in more detail in the context of at least FIG. 18. Data storage 1804 can store instructions, such as RF control software (RFCS) 254 that can be used to control RF subsystem 250, and data, such as attenuation profile (AP) 248. Attenuation profiles are discussed in more detail in the context of at least this figure and FIGS. 7, 11, and 13.

Computing device 252 and RF control software 254 can be used to provide a user interface that enables creation, reviewing, updating, and removal of RF customization data, such as attenuation profiles and timing controls. In some embodiments, computing device 252 and RF control software 254 can provide controls to activate and deactivate switches in switchable pulse forming networks 284*a* and/or 284*b*. In other embodiments, computing device 252 and RF control software 254 can generate one or more graphs for particle accelerator 200, including but not limited to graphs discussed below in the context of FIGS. 3, 5, 6, 8, 9, 10, 12, 14, 16, and/or 17.

Timing generator 256 can receive inputs from computing device 252 and provides trigger and perhaps other control signals as outputs for use in coordinating components of RF subsystem 250. For example, timing generator 256 can provides trigger and/or other control signals to coordinate arbitrary waveform generators 260*a*, 260*b*, voltage controlled attenuators 262*a*, 262*b*, RF switches 264*a*, 264*b*, pulse amplifiers 268*a*, 268*b*, klystrons 270*a*, 270*b*, and/or RF generator 280. In some embodiments, timing generator 256 can include a trigger generator. The trigger generator can be used to provide triggers, or timing pulses, to the components of RF subsystem 250. In particular embodiments, the trigger generator can pulse in single pulse mode or at various repetition rates.

The triggers generated by the trigger generator can be controlled by an operator of particle accelerator 200 (e.g., via a user interface of RF control software 254, such as user interface 400) and/or an external pulse generator. In some embodiments, trigger pulses can be provided to an RF driver and modulators of one or more klystrons and external instrumentation. In particular, triggers can indicate: when RF generator 280 is to start generating RF waves, when RF switches 264*a* and/or 264*b* are to be open or closed, when energy from switchable pulse forming network 284*a* and/or 284*b* are to be applied to klystrons 270*a* and/or 270*b*, and/or when to provide amplified pulsed RF signals 238*a*, 238*b* to accelerating guide 234.

RF generator 280 can produce one or more known RF waves, such as a continuous, constant-amplitude RF sinusoidal wave. For example, an RF generator 280 can provide a constant amplitude sinusoidal signal of a fixed frequency, such as a frequency in the range of 1-2 GHz, e.g., 1.282 GHz. In some embodiments, the duration of the constant amplitude sinusoidal signal can be specified by an accelerator operator using a timing control interface provided by RF control software 254.

The RF waves provided by RF generator 280 can be provided to RF Tee 282, which can provide the RF waves to both voltage controlled attenuators 262*a*, 262*b* of respective stages 1 and 2.

Each of switchable pulse forming networks 284*a*, 284*b* can act as a pulsed voltage supply. Switchable pulse forming networks 284*a*, 284*b* can provide energy for generating respective amplified pulsed RF signals 238*a*, 238*b* for a maximum fixed duration of time (e.g., 100 μs) or switched on-and-off for one or more pulse durations that are less than or equal to the maximum fixed duration (e.g., 5 μs, 10 μs, 20 μs, 50 μs) using one or more switches. In some embodiments, RF switches 264*a*, 264*b* can control the pulse duration(s). In other embodiments, the pulse duration(s) can be controlled based on the number of inductor/capacitor stages and/or switches in the respective networks 284*a*, 284*b*, such as stages 1512 and/or switches 1510 and/or 1520.

Figure 15:
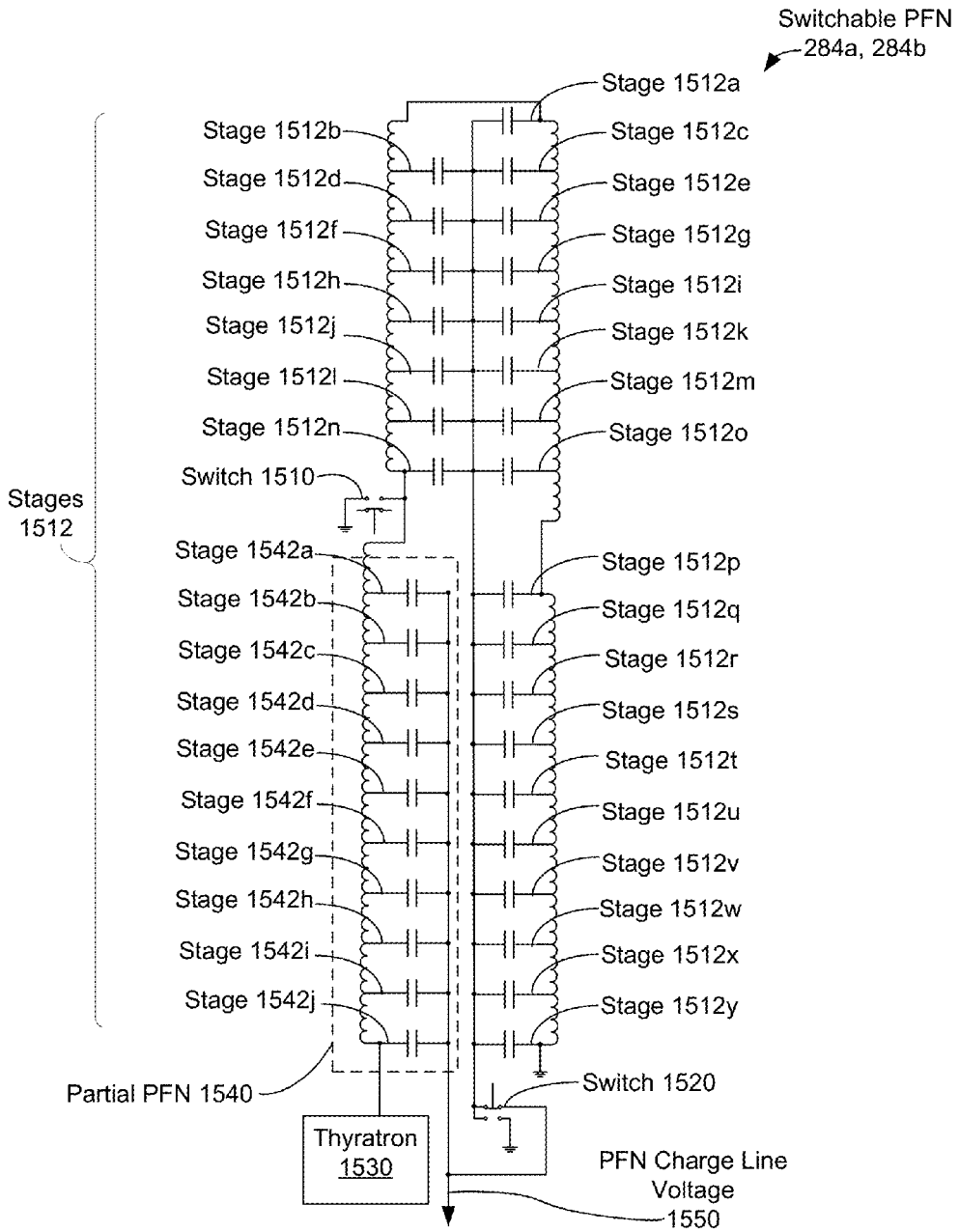
FIG. 15 is a circuit diagram for a switchable pulse forming network, in accordance with an example embodiment.

As discussed in more detail with respect to FIG. 15, each of stages 1512 can include one or more capacitors and one or more inductors. Switches 1510 and/or 1520 can control performance of a switchable pulse forming network 284*a*, 284*b*. For example, switches 1510 and/or 1520 can control the duration of the pulsed voltage supply provided by a switchable pulse forming network 284*a*, 284*b*.

In particular of these embodiments, the timing control interface can control switches 1510, 1520 in switchable pulse forming networks 284*a* and/or 284*b* to produce the pulse durations; e.g., switchable pulse forming network 284*a* or 284*b* can have at least two possible pulse durations of ~10 μs and ~100 μs based on settings of switches 1510 and 1520. In still other embodiments, RF subsystem 250 can have more, fewer, and or different pulse forming networks than switchable pulse forming networks 284*a*, 284*b*.

Stages 1 and 2 can generate respective stage 1 amplified pulsed RF signals 238*a* and stage 2 amplified pulsed RF signals 238*b* of RF subsystem 250. As mentioned above, stage 1 amplified pulsed RF signals 238*a* and stage 2 amplified pulsed RF signals 238*b* can include pulses of RF energy that are provided to accelerating guide 234 of particle accelerator 200 to accelerate electrons traveling through accelerating guide 234 and generate resulting accelerator beam output 240 to target area 242.

Arbitrary waveform generators 260*a*, 260*b* can be controlled by attenuation profile 248 stored and/or generated by computing device 252 and/or RF control software 254. Attenuation profile 248 can include data specifying one or more waveforms and/or one or more durations related to a session of utilizing particle accelerator 200. The arbitrary waveform generators 260*a*, 260*b* can use the attenuation profile to produce one or more waveforms 244*a*, 244*b*. For example, the attenuation profile can modify (e.g., lower and/or raise) the voltage amplitude of a waveform 244*a*, 244*b* produced by one or more of arbitrary waveform generators 260*a*, 260*b*.

Voltage controlled attenuators (VCAs) 262*a*, 262*b* can generate pulsed RF signals 246*a*, 246*b* by attenuating constant-amplitude RF waves provided by RF generator 280 based on voltages in waveforms 244*a*, 244*b* provided by respective arbitrary waveform generators 260*a*, 260*b*. For example, voltage controlled attenuators 262*a*, 262*b* can attenuate the constant-amplitude RF waves in inverse proportion to the voltages in waveforms 244*a*, 244*b*. That is, when more voltage is provided to voltage controlled attenuators 262*a*, 262*b*, the voltage controlled attenuators 262*a*, 262*b* provide less attenuation of the constant-amplitude RF waves. By attenuating the constant-amplitude RF waves, voltage controlled attenuators 262*a*, 262*b* can proportionately change the wave shape of the constant-amplitude RF waves to generate pulsed RF signals 246*a*, 246*b*.

In some examples, no attenuation profiles are provided to arbitrary waveform generators 260*a*, 260*b*—in these examples, arbitrary waveform generators 260*a*, 260*b* may provide a constant-voltage waveform as waveforms 244*a*, 244*b*, and so the constant-amplitude RF waves may not be attenuated by voltage controlled attenuators 262*a*, 262*b* in generating pulsed RF signals 246*a*, 246*b*.

Pulsed RF signals 246*a*, 246*b* can be amplified by pulse amplifiers 268*a*, 268*b* and then be input as (relatively) low-powered RF signals to klystrons 270*a*, 270*b*. Klystrons 270*a*, 270*b* can act as large pulsed power amplifiers of the low-powered RF signals using energy provided by respective switchable pulse forming networks 284*a*, 284*b*. To provide amplified RF outputs; e.g., amplified pulsed RF signals 238*a* or 238*b*, each klystron 270*a*, 270*b* can receive two inputs: a pulsed voltage supply from respective switchable pulse forming network 284*a*, 284*b* at a cathode of the klystron and a low-powered RF signal from respective RF pulse amplifier 268*a*, 268*b* that has amplified respective pulsed RF signals 246*a*, 246*b*.

The klystron can then amplify the low-powered RF signal using energy provided by the pulsed voltage supply. That is, a klystron, such as one of klystrons 270*a*, 270*b*, can only amplify RF inputs for a duration that one of switchable pulse forming networks 284*a*, 284*b* is "on" or providing energy to the klystron. In stage 2, phase shifter 266 can adjust the phase of the low-powered RF signal received by klystron 270*b* via pulse amplifier 268*b*. The now-amplified pulsed RF signals produces by klystrons 270*a*, 270*b* can be provided as respective stage 1 amplified pulsed RF signals 238*a* and stage 2 amplified pulsed RF signals 238*b* to accelerating guide 234.

In some embodiments, one or more thyratrons can be used to operate klystrons 270 and/or 270*b*. A thyratron can be a high-powered electrical switch and controlled rectifier that can handle a relatively large amount of current. A modulator high voltage power supply can apply high voltage, such as PFN charge line voltage 1550 of FIG. 15, to charge a switchable pulse forming network (e.g., one of switchable pulse forming network 284*a*, 284*b*). The switchable pulse forming network can be discharged by applying a high voltage trigger pulse to a thyratron switch tube associated with the switchable pulse forming network. The output pulses from the switchable pulse forming network through the thyratrons are applied to the cathodes of klystrons 270*a* and/or 270*b*. While klystrons 270*a* and/or 270*b* receive the cathode pulses, the klystron(s) can also receive the low-powered RF signal from RF pulse amplifier(s) 268*a* and/or 268*b*. The klystron(s) can amplify the low-powered RF signal to generate pulses of high-powered RF energy as amplified pulsed RF signal(s) 238*a*, 238*b*.

Changes in stage 1 amplified pulsed RF signals 238*a* and stage 2 amplified pulsed RF signals 238*b* can affect acceleration of charged particles, such as electrons, in accelerated beam output 240. For example, if the constant-amplitude RF waves provided by RF generator 280 are not attenuated by voltage controlled attenuators 262*a*, 262*b* (i.e., when no attenuation profiles are provided to arbitrary waveform generators 260*a*, 260*b*), then electrons in accelerated beam output 240 can produce a square-wave output of a fixed duration at target area 242. As another example, if the constant-amplitude RF waves provided by RF generator 280 are attenuated by voltage controlled attenuators 262*a*, 262*b* based on waveforms 244*a*, 244*b* (i.e., when one or more attenuation profiles are provided to arbitrary waveform generators 260*a*, 260*b*), then electrons in accelerated beam output 240 can produce a non-square-wave output of a fixed duration in target area 242.

RF subsystem 250 can be used to provide variable-shape and variable-duration pulses of RF energy in stage 1 amplified pulsed RF signals 238*a* and stage 2 amplified pulsed RF signals 238*b* provided to accelerating guide 234. The shape of pulses of RF energy in s amplified pulsed RF signals 238*a* and/or 238*b* can be customized using attenuation profile 248. In some examples, attenuation profile 248 can be a user-generated attenuation profile that drives arbitrary waveform generators 260*a*, 260*b* and voltage controlled attenuators 262*a*, 262*b* to generate respective waveforms 244*a*, 244*b* and pulsed RF signals 246*a*, 246*b*. The duration of pulses of RF energy in amplified pulsed RF signals 238*a* and/or 238*b* can be controlled using timing controls that can, for example, activate or deactivate switches, such as RF switches 264*a*, 264*b* and/or switches in switchable pulse forming networks 284*a* and/or 284*b* that direct duration of pulsed energy provided by switchable pulse forming networks 284*a* and/or 284*b* to respective klystrons 270*a* and/or 270*b*.

In some embodiments, the duration of pulses of RF energy in amplified pulsed RF signals 238*a* and/or 238*b* can be controlled based on a duration related to an attenuation profile, such as attenuation profile 248. For example, if an attenuation profile specifies a pulse of duration D, then waveforms 244*a* and/or 244*b*, pulsed RF signals 246*a* and/or 248*a*, and the amplified pulsed RF signals 238*a* and/or 238*b* include a pulse of duration D. Other examples of attenuation profiles controlling durations of pluses of RF energy in amplified pulsed RF signals 238*a* and/or 238*b* are possible as well.

In some embodiments, one or more associated systems can be used to ensure proper operation of particle accelerator 200. For example, monitoring hardware and/or software can be included to observe the average collector current, body temperature, and the magnet current of a klystron, such as one of klystrons 270*a*, 270*b*. Operation of the klystron can be stabilized using the monitoring hardware and/or software. Further, the monitoring hardware and/or software can be wired to a safety interlock system to ensure safe operation of particle accelerator 200.

Figure 3:
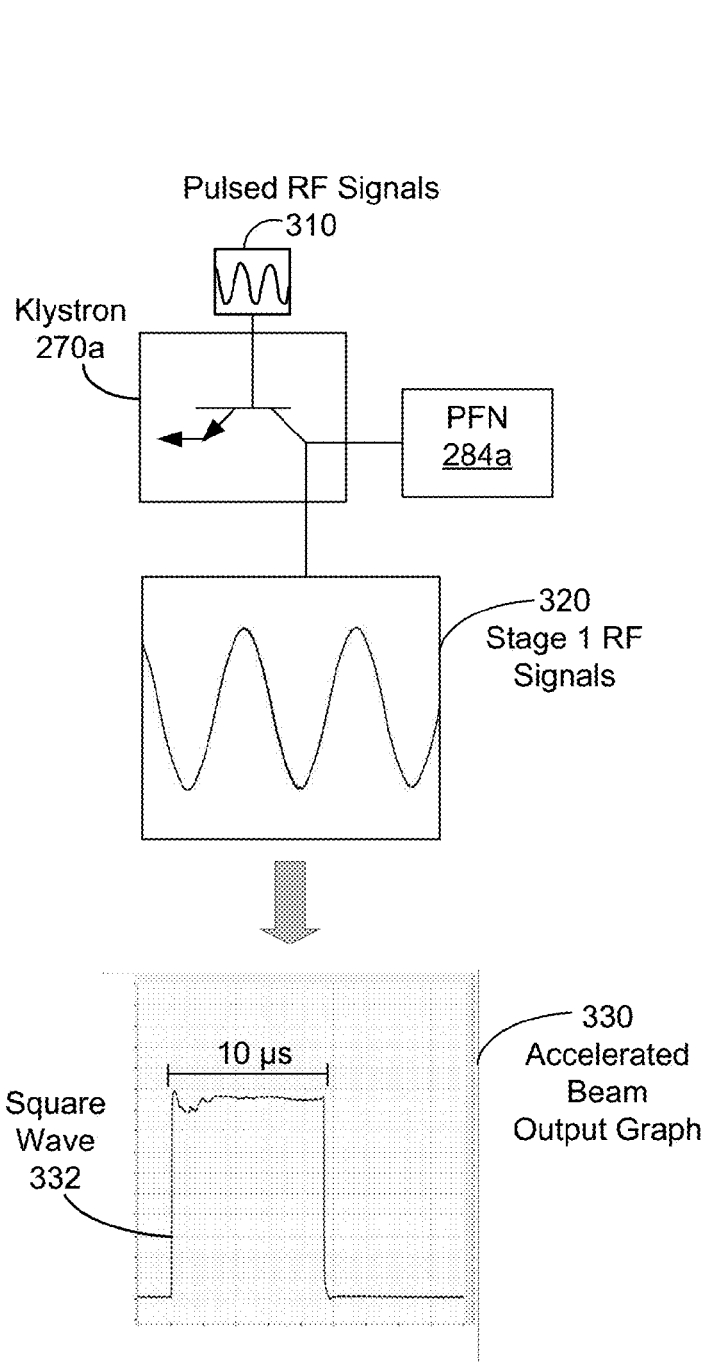
FIG. 3 is a diagram of selected components of the RF subsystem of the particle accelerator of FIG. 2 utilized in a scenario, in accordance with an example embodiment.

FIG. 3 is a diagram of selected components of RF subsystem 250 of particle accelerator 200 utilized in scenario 300, in accordance with an example embodiment. Scenario 300 involves a constant-amplitude sine-wave being generated by RF generator 280 as pulsed RF signals 310, which is not attenuated by voltage controlled attenuators 262*a*, 262*b*; i.e., no attenuation profile is provided to arbitrary waveform generators 260*a*, 260*b* during scenario 300. Pulsed RF signals 310 and energy from pulse forming network 284*a* are provided as an inputs to klystron 270*a*.

Klystron 270*a* then amplifies the constant-amplitude sine-wave to produce stage 1 RF signals 320. When stage 1 RF signals 320 (and similar stage 2 RF signals that are not shown in FIG. 3) are provided to accelerating guide 234, stage 1 RF signals 320 accelerate electrons of electron beam 232 injected into accelerating guide 234 uniformly over time to generate accelerated beam output 240. The uniform acceleration of electrons in accelerated beam output 240 is illustrated as a square output pulse 332 in accelerated beam output graph 330.

During scenario 300, the pulse duration of pulse forming network 284*a* is 100 μs, an RF input duration (i.e., how long stage 1 RF signals 320 are provided to accelerating guide 234) is approximately 29 μs, and injector duration (i.e., how long electron beam 232 injects electrons into accelerating guide 234) is approximately 10 μs. As illustrated in FIG. 3, a pulse length shown in graph 330 is 10 μs as the output pulse length is limited by the injector duration of 10 μs. In a related scenario where injector duration exceeds 29 μs, then the output pulse length would be limited by the RF input duration 29 μs, as electrons in electron beam 232 are only accelerated through accelerating guide 234 while stage 1 RF signals 320 are provided to accelerating guide 234.

Figure 4:
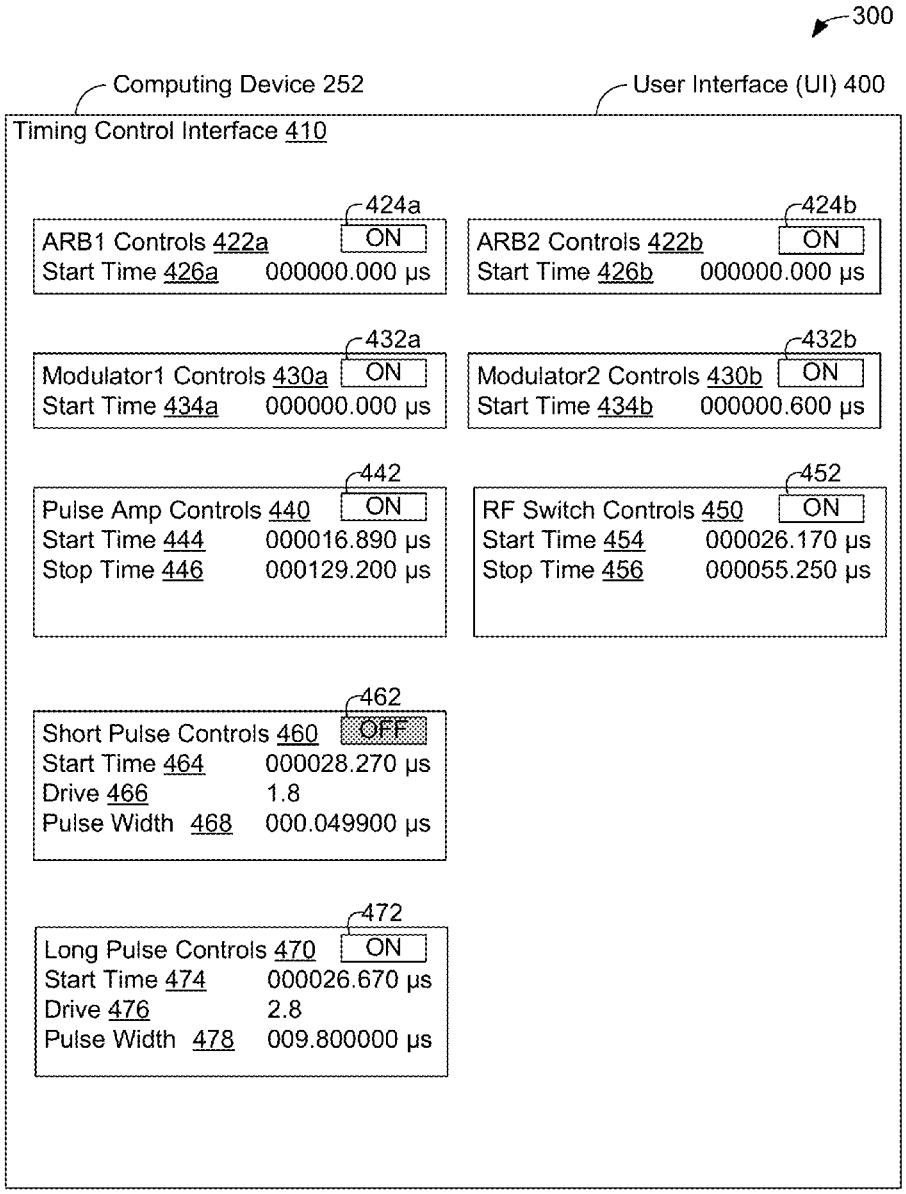
FIG. 4 depicts a timing control interface of a user interface used in the scenario of FIG. 3, in accordance with an example embodiment.

FIG. 4 depicts timing control interface 410 of user interface 400 used in scenario 300, in accordance with an example embodiment. User interface 400, including timing control interface 410, can be provided by computing device 252. For example, computing device 252 can execute RF control software 254, which can include instructions that, when executed by one or more processors of computing device 252, cause computing device 252 to provide user interface 400.

Timing control interface 410 can be used to create, review, update, save, load, create, and/or delete user-selectable controls that can be used to regulate timing, and perhaps other aspects, of one or more components of particle accelerator 200. For example, FIG. 4 shows timing control interface 410 with: arbitrary waveform generator controls 422*a* for regulating arbitrary waveform generator 260*a*, arbitrary waveform generator controls 422*b* for regulating arbitrary waveform generator 260*b*, modulator controls 430*a* for regulating voltage controlled attenuator 262*a*, modulator controls 430*a* for firing a thyratron, such as thyratron 1530 of FIG. 15, pulse amplifier controls 440 for regulating pulse amplifiers 268*a*, 268*b*, and RF switch controls 450 for regulating RF switches 264*a*, 264*b*.

Timing control interface 410 can also include pulse-related controls to regulate duration, and perhaps other aspects, of pulses of injected particles provided to accelerating guide 234 and consequently provided in accelerated beam output 240 to target area 242. For example, FIG. 4 shows timing control interface 410 with: short pulse controls 460 for regulating relatively short duration pulses of injected particles and with long pulse controls 470 for regulating relatively short duration pulses of injected particles.

Each of controls 422*a*, 422*b*, 430*a*, 430*b*, 440, 450, 460, and 470 of timing control interface 410 can be activated or deactivated using respective on-off buttons 424*a*, 424*b*, 432*a*, 432*b*, 442, 452, 462, and 472. If an on-off button is set to "ON", such as shown in FIG. 4 for on-off buttons 424*a*, 424*b*, 432*a*, 432*b*, 442, 452, and 472, then the respective control is activated. And, if an on-off button is set to "OFF", such as shown in FIG. 4 for on-off button 462, then the respective control is deactivated. For the example shown in FIG. 4, each of controls 422*a*, 422*b*, 430*a*, 430*b*, 440, 450, and 470 are activated and short pulse controls 460 are deactivated.

When controls of timing control interface 410 are activated, then the activated controls can be used to regulate a session for using particle accelerator 200 based on additional data of the activated controls. For example, since on-off button 442 of pulse amplifier controls 440 is ON, then start time value 444 and stop time value 446 of pulse amplifier controls 440 can be used to regulate pulse amplifiers 268*a*, 268*b*. In the particular example shown in FIG. 4, start time value 444 and stop time value 446 are set, respectively, to 16.890 μs and 129.200 μs. Thus, pulse amplifier controls 440 are set to start pulse amplifiers 268*a*, 268*b* at a time 16.890 μs after the beginning of a session using particle accelerator 200, and to stop pulse amplifiers 268*a*, 268*b* 129.200 μs after the beginning of a session using particle accelerator 200—that is, pulse amplifiers 268*a*, 268*b* are to be active for 112.310 μs starting 16.890 μs after the beginning of the session.

In particular, RF switch controls 450 can be used to regulate a duration that (attenuated) RF waves are provided to pulse amplifiers 268*a*, 268*b* via respective RF switches 264*a*, 264*b*—in the example shown in FIG. 4, RF switches 264*a*, 264*b* are to be active during an interval starting 26.170 μs after the beginning of the session and stopping 55.250 μs after the beginning of the session—that is, RF switches 264*a*, 264*b* are to be active for 29.08 μs starting 26.170 μs after the beginning of the session. As mentioned above in the context of FIG. 2, during scenario 300, the RF input duration is 29 μs. This input duration of 29 μs can be confirmed by the values of RF switch controls 450 indicating that RF switches 264*a*, 264*b* are to be only to be active for a 29.08 μs interval, and so RF input can be provided to respective pulse amplifiers 268*a*, 268*b* and klystrons 270*a*, 270*b* only during the same 29.08 μs interval.

Short pulse controls 460 include start time 464, drive 466, and pulse width 468. Similarly, long pulse controls 470 include start time 474, drive 476, and pulse width 478. In particular, long pulse controls 470 have start time 474 set to 26.670 μs, indicating that pulse amplifiers 268*a*, 268*b* are to be started 0.500 μs after the RF input duration begins. Further, long pulse controls 470 have pulse width 478 set to 9.8 μs, indicating that particles are to be injected for 9.8 μs corresponding to the injector duration of 10 μs for scenario 300 discussed above in more detail in the context of graph 230 of FIG. 2. That is, based on long pulse controls 470, particles are to be injected between 26.670 μs and 36.470 μs after the start of the session using particle accelerator 200.

Figure 5:
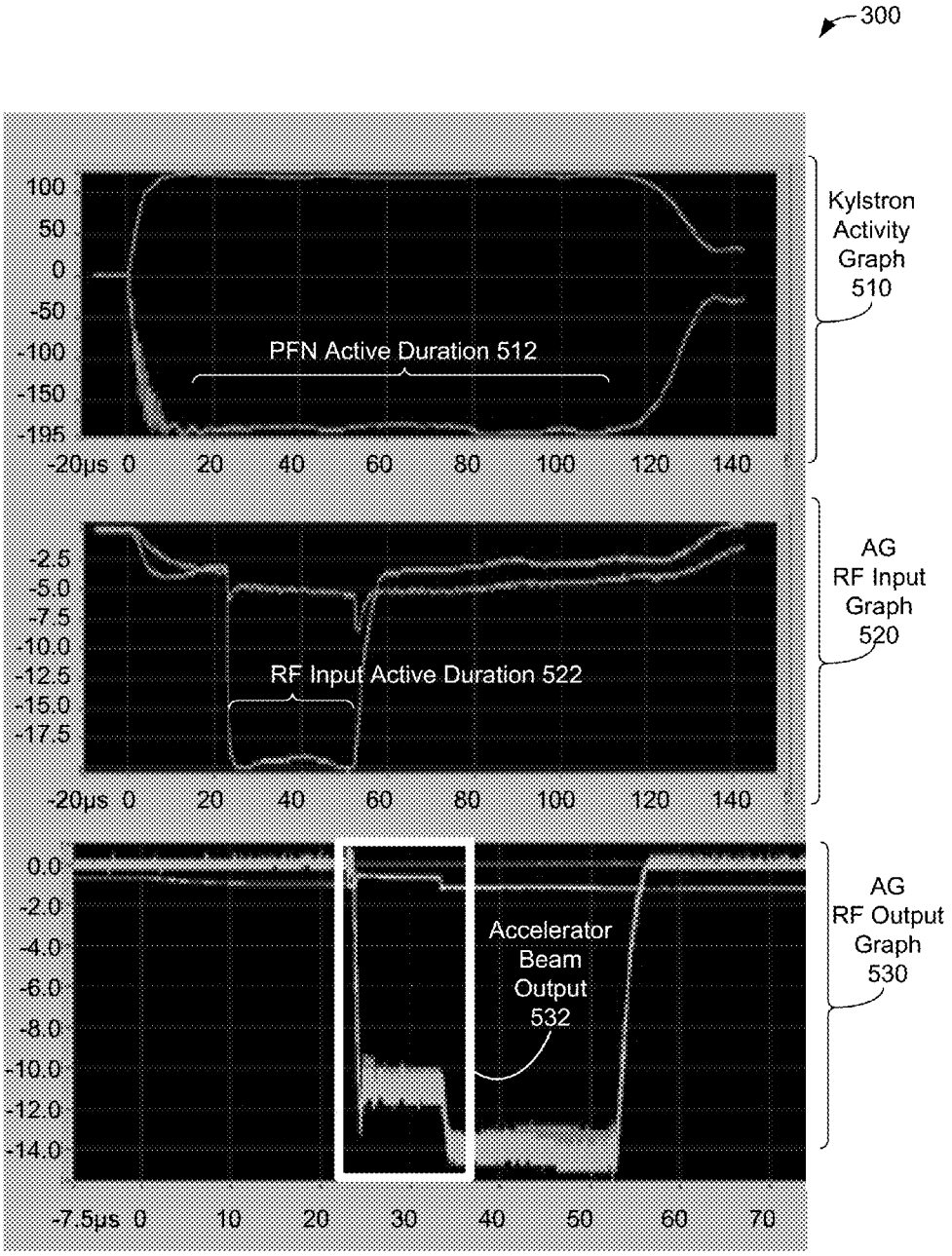
FIG. 5 depicts a klystron activity graph, an acceleration guide RF input graph, and an acceleration guide RF output graph for the scenario of FIG. 3, in accordance with an example embodiment.

FIG. 5 depicts klystron activity graph 510, acceleration guide (AG) RF input graph 520, and acceleration guide RF output graph 530 for scenario 300, in accordance with an example embodiment. Klystron activity graph 510, acceleration guide RF input graph 520, and acceleration guide RF output graph 530 can be generated by a computing device, such as computing device 252 executing RF control software 254, based on data obtained before, during, and/or after a session of using particle accelerator 200.

Klystron activity graph 510 shows a pulse forming network active duration 512 during scenario 300 between about 15 μs and about 115 μs after the beginning of the session as indicated by the X-axis of graph 510. That is, pulse forming network active duration 512 indicates that switchable pulse forming networks 284*a* and/or 284*b* were discharging for about 100 μs during the session. In some embodiments, a pulse forming network duration of 100 μs can indicate that switches of switchable pulse forming networks 284*a* and/or 284*b* were set so that the entirety of switchable pulse forming networks 284*a* and/or 284*b* was active during the session. In these embodiments, a shorter pulse forming network duration; e.g., a pulse forming network duration of 10-50 μs, can indicate that the switches of switchable pulse forming networks 284*a* and/or 284*b* were set so that only a portion of switchable pulse forming networks 284*a* and/or 284*b* was active during the session.

Acceleration guide RF input graph 520 shows an RF input active duration 522 between about 25 μs and about 55 μs after the beginning of the session as indicated by the X-axis of graph 520. That is, RF input active duration 522 indicates that RF inputs were provided for about 30 μs during the session. Acceleration guide RF input graph 520 can be considered to be in conformity with RF switch controls 450 providing RF inputs during an interval between 26.170 and 55.250 μs after the beginning of the session, where RF switch controls 450 were discussed above with regards to FIG. 4.

Acceleration guide RF output graph 530 of FIG. 5 illustrates actual accelerator output including accelerator beam output 632 for about 10 μs between about 25 and 35 μs after the beginning of the session. Acceleration guide RF output graph 530 can be considered to be in conformity with long pulse controls 470 for injecting particles during an interval between 26.670 and 36.470 μs after the beginning of the session. Long pulse controls 470 were discussed above with regards to FIG. 4.

Figure 6:
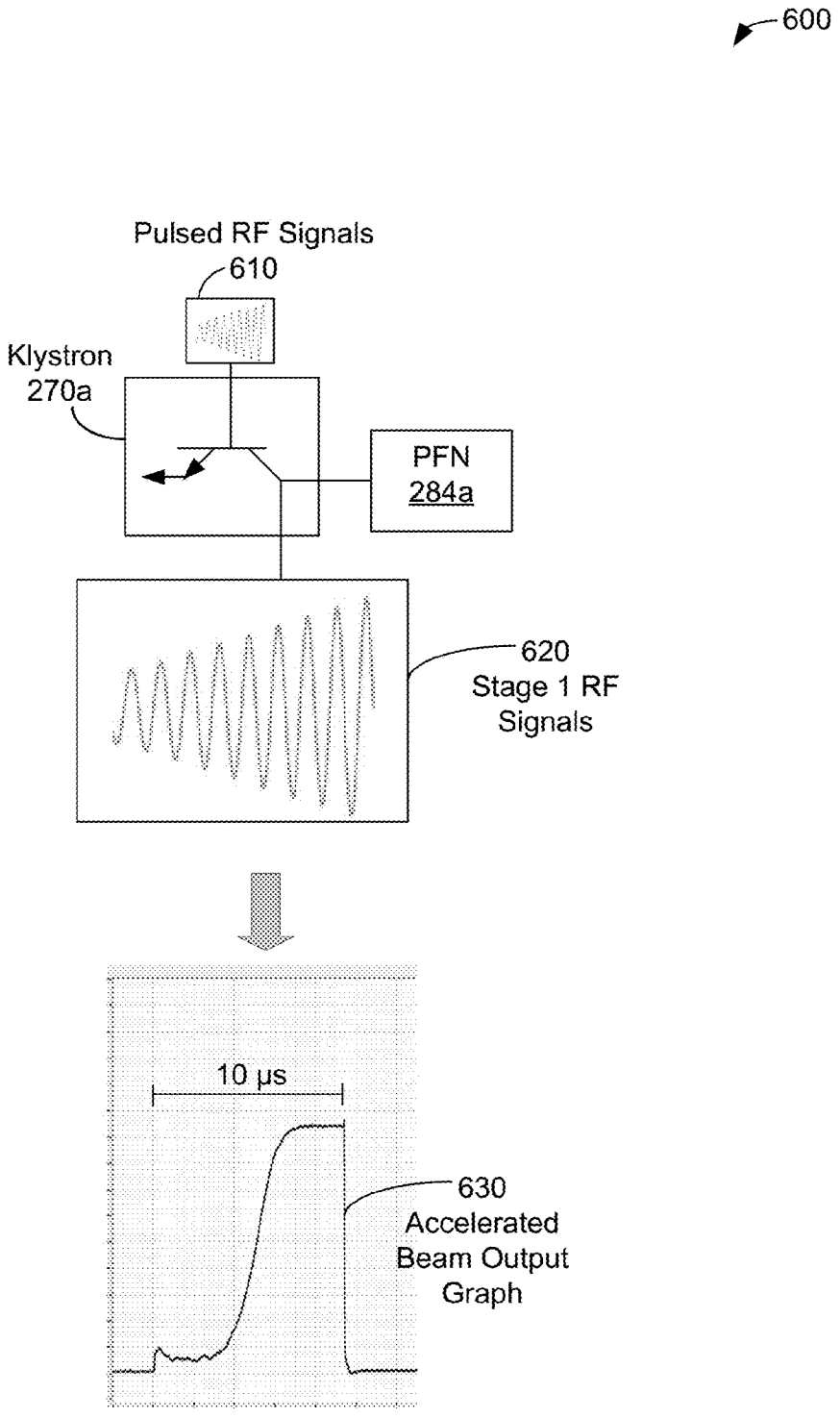
FIG. 6 is a diagram of selected components of the RF subsystem of the particle accelerator of FIG. 2 utilized in another scenario, in accordance with an example embodiment.

FIG. 6 is a diagram of selected components of RF subsystem 250 of particle accelerator 200 utilized in scenario 600, in accordance with an example embodiment. Scenario 600 involves a constant-amplitude sine-wave being generated by RF generator 280, which is attenuated by voltage controlled attenuator 262*a* as part of pulsed RF signals 610, which is provided to klystron 270*a* along with energy from pulse forming network 284*a*.

In scenario 600, an attenuation profile is provided by computing device 252 to at least arbitrary waveform generators 260*a* which in turn generates a waveform based on the attenuation profile. In scenario 600, the attenuation profile and consequent waveform indicate an initial strong constant attenuation which then ramps down to no attenuation. The waveform generated by arbitrary waveform generator 260*a* is provided to voltage controlled attenuator 262*a* to attenuate an RF input (e.g., the constant-amplitude sine-wave generated by RF generator 280 during scenario 600) in accordance with the attenuation profile. The attenuated RF input is then amplified by pulse amplifier 268*a* to generate pulsed RF signals 610 which are provided to klystron 270*a*.

Klystron 270*a* then amplifies pulsed RF signals 610 to produce stage 1 RF signals 620. When stage 1 RF signals 620 (and similar stage 2 RF signals not shown in FIG. 6) are provided to accelerating guide 234, stage 1 RF signals 620 accelerate electrons of electron beam 232 injected into accelerating guide 234. The output amplitude of particle accelerator 200 is initially relatively small during scenario 600 then gradually increasing until reaching a maximum toward the end of a 10 μs pulse length, as illustrated by accelerated beam output graph 630. That is, accelerated beam output graph 630 indicates that output amplitude is relatively small during times of strong attenuation of the RF input and the output amplitude is relatively large during times of little or no attenuation of the RF input.

During scenario 600, the pulse duration of pulse forming network 284*a* is approximately 100 μs, an RF input duration is 29 μs, and injector duration is 10 μs—these values are unchanged from scenario 300 discussed above in the context of FIG. 3. The pulse length shown in graph 630 is 10 μs which was limited by the injector duration of 10 μs.

Figure 7:
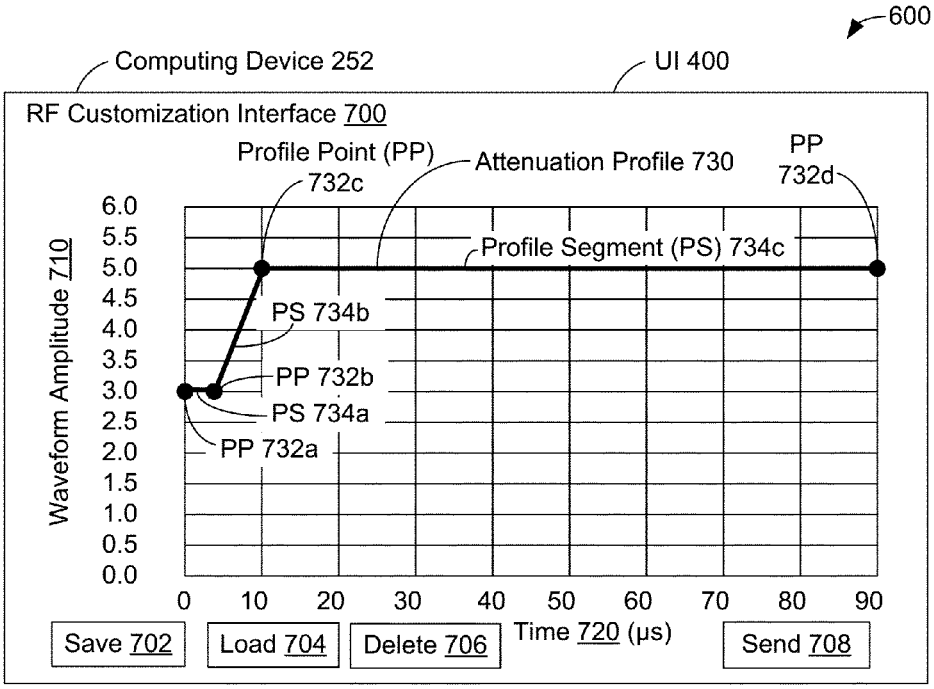
FIG. 7 depicts an RF customization interface of a user interface used in the scenario of FIG. 6, in accordance with an example embodiment.

FIG. 7 depicts RF customization interface 700 of user interface 400 used in scenario 600, in accordance with an example embodiment. RF customization interface 700 can be used to create, review, update, save, load, and/or delete one or more attenuation profiles; e.g., attenuation profile 730. For example, a touch screen, mouse, or other input device can be used to provide inputs RF customization interface 700 that can be used to specify profile points and/or segments of attenuation profile 730. In scenario 600, after attenuation profile 730 has been specified using RF customization interface 700, attenuation profile 730 is then transmitted from computing device 252 to arbitrary waveform generator 260*a* after send button 708 is pressed. Upon reception of attenuation profile 730, arbitrary waveform generator 260*a* can generate a waveform of voltages corresponding to attenuation profile 730. The waveform of voltages can be provided to attenuator 262*a* to attenuate an RF input as discussed above.

RF customization interface 700 can be used to set one or more profile points (PPs) for a specific waveform amplitude, as illustrated by waveform amplitude axis 710, at a specific time, as illustrated by time axis 720, of an attenuation profile. Waveform amplitude axis 710 indicates an amplitude of the waveform that can be generated by a waveform generator; e.g. arbitrary waveform generator 260*a*, 260*b*. The attenuation of an input RF signal is inversely related to waveform amplitude, and so RF waves generated by RF generator 280 can range from being completely attenuated for a waveform amplitude of 0.0, to being completely unattenuated for a maximum waveform amplitude, such as the 5.0 amplitude shown by RF customization interface 700.

Time axis 720 shows time from the beginning of an RF input duration during a session using particle accelerator 200. For example, profile points 732*a*, 732*b*, 732*c*, 732*d* of attenuation profile 730 indicate respective waveform amplitudes of 3.0, 3.0, 5.0, and 5.0 at respective times from the beginning of the RF input duration of 0 μs, 2 μs, 10 μs, and 90 μs.

RF customization interface 700 can also be used to generate profile segments (PSs) connecting profile points of an attenuation profile. In FIG. 7, profile segment 734*a* is between profile points 732*a* and 732*b*; profile segment 734*b* is between profile points 732*b* and 732*c*; and profile segment 734*c* is between profile points 732*c* and 732*d*. In the example shown in FIG. 7, profile segments 734*a*, 734*b*, 734*c* are shown as straight lines connecting profile points 732*a*-732*d*, leading to attenuation profile 730 being a ramp attenuation profile.

During scenario 600, a waveform generated based on attenuation profile 730 is applied to the constant-amplitude RF produced by the RF generator 280 to generate pulsed RF signals 610. The waveform can include voltages generated by arbitrary waveform generator 260*a*, 260*b* as specified as waveform amplitudes of an attenuation profile, such as a waveform specified using profile points and profile segments of attenuation profile 730. The duration of a pulsed RF signal can be based on timing controls and/or a maximum time specified in an attenuation profile, such the maximum time of 90 μs specified for profile point 732*d* and profile segment 734*c* of attenuation profile 730. In some embodiments, an attenuation profile can include timing information, such as timing controls specified using timing control interface 410. In particular of these embodiments, the timing information can include settings for switches of switchable pulse forming network 274*a*, 274*b*—then, a duration of an amplified pulsed RF signal, such as stage 1 RF signals 620, can be based on one or more settings of the plurality of the switches switchable pulse forming network 284*a*, 284*b*.

In other examples, other linear and/or non-linear paths than straight lines connecting profile points can be used as profile segments; e.g., sinusoidal paths, square waves, quadratic or higher order paths, and perhaps other paths connecting profile points can be used as profile segments.

RF customization interface 700 can also include various controls related to attenuation profile management. FIG. 7 shows RF customization interface 700 with save button 702 that can be used to save an attenuation profile on to non-volatile/permanent storage, load button 704 that can be used to obtain an attenuation profile from non-volatile/permanent storage, delete button 706 that can be used to erase an attenuation profile from non-volatile/permanent storage, and send button 708 that can be used to transmit an attenuation profile; e.g, to an arbitrary waveform generator and/or to another computing device. In other examples, RF customization interface 700 can include more, fewer, and/or different controls. In still other examples, RF customization interface 700 can use more, fewer, and/or different user-interface techniques to provide controls such as buttons 702-708; e.g., pull-down menus, icons, dialogs, pop-ups.

Figure 8:
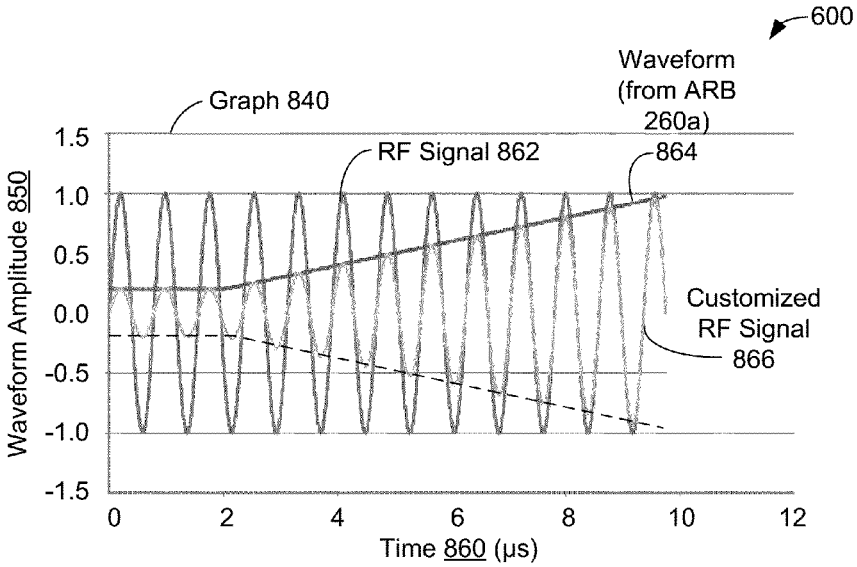
FIG. 8 is a graph of an customized RF signal used in the scenario of FIG. 6, in accordance with an example embodiment.

FIG. 8 depicts graph 840 of customized RF signal 866 used in scenario 600, in accordance with an example embodiment. Graph 840 includes an X-axis 860 illustrating time from the beginning of an RF input duration, and a Y-axis 850 illustrating waveform amplitude. Graph 840 also includes a depiction of RF signal 862, which is a constant-amplitude sine wave provided by RF generator 280, and a depiction of waveform 864, which is a ramped signal corresponding to and based on attenuation profile 730. FIG. 8 also shows a dotted line indicating a reflection of waveform 864 about an axis indicated by a 0.0-valued attenuation.

As illustrated by FIG. 8, customized RF signal 866 can be generated by combining RF signal 862 and waveform 864. As such, RF signal 862 can be attenuated, or limited by, waveform 864. In scenario 600, customized RF signal 866 is generated by voltage controlled attenuator 262*a* by applying waveform 864 to attenuate RF signal 862. Waveform 864 can be a waveform of voltages provided by arbitrary waveform generator 260*a* RF signal 862 can be a constant-amplitude sine wave RF signal provided by RF generator 280 (via RF Tee 282). Customized RF signal 866 can then be amplified by a pulse amplifier; e.g., pulse amplifier 268*a*, before being provided as RF signals 610 to klystron 270*a*.

Figure 9:
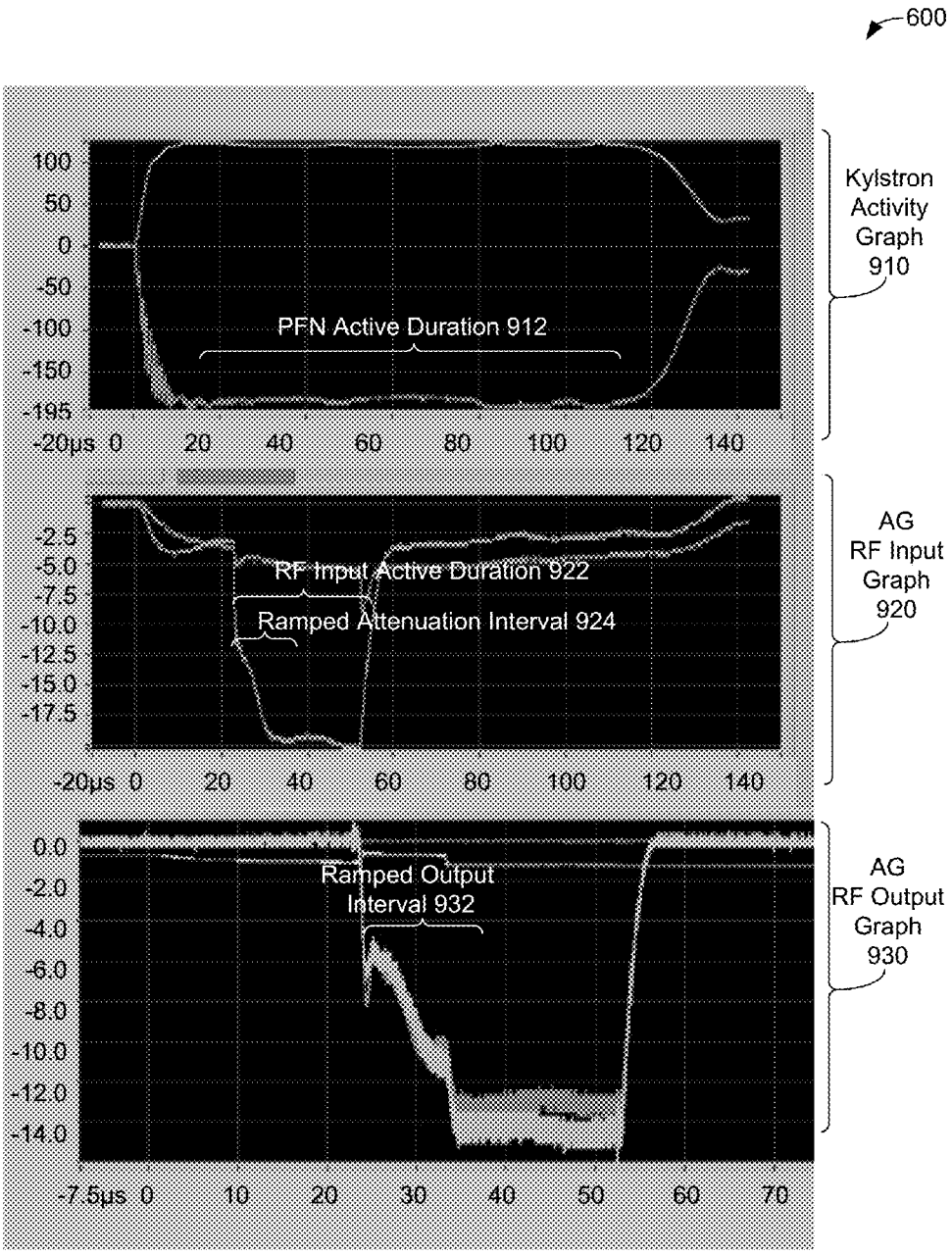
FIG. 9 depicts a klystron activity graph, an acceleration guide RF input graph, and an acceleration guide RF output graph for the scenario of FIG. 8, in accordance with an example embodiment.

FIG. 9 depicts klystron activity graph 910, acceleration guide RF input graph 920, and acceleration guide RF output graph 930 for scenario 600, in accordance with an example embodiment. Klystron activity graph 910, acceleration guide RF input graph 920, and acceleration guide RF output graph 930 can be generated by a computing device as discussed above in the context of FIG. 5. Klystron activity graph 910 is virtually the same as klystron activity graph 510 of FIG. 5 As shown in FIG. 9, klystron activity graph 910 illustrates pulse forming network active duration 912 during scenario 600 between about 15 μs and about 115 μs after the beginning of the session; i.e., switchable pulse forming network 284*a*, 284*b* was discharging for about 100 μs during the session as discussed above in the context of FIG. 5.

Acceleration guide RF input graph 920 shows the effects of attenuation profile 730. The ramped attenuation indicated by attenuation profile 730 is shown in acceleration guide RF input graph 920 as reduced RF power during RF ramped attenuation interval 924 as RF input active duration 922 begins. Note that in acceleration guide RF input graph 920, RF power is shown as increasing as the Y-axis values get progressively more negative (that is, as acceleration guide RF input graph 920 goes toward the bottom of FIG. 9). Then, during RF ramped attenuation interval 924, RF power starts at a relative minimum power level and ramps up to full power (no attenuation), as indicated by profile segment 834*b* of attenuation profile 730. Acceleration guide RF input graph 920 of FIG. 9 also shows that RF power stays at full power during the remainder of RF input active duration 922, as correspondingly indicated by profile segment 734*c* of attenuation profile 730.

FIG. 9 shows acceleration guide RF output graph 930 indicating actual accelerator output including ramped output interval 932 where accelerator beam output was reduced during an interval corresponding to RF ramped attenuation interval 924. Note that in acceleration guide RF output graph 930, acceleration guide RF output is shown as increasing as the Y-axis values get progressively more negative (that is, as acceleration guide RF output graph 930 goes toward the bottom of FIG. 9). After ramped output interval 932, acceleration guide RF output maintains a relative-maximum value, which corresponds to RF power levels at full power during the remainder of RF input active duration 922 discussed above. Acceleration guide RF input graph 920 and acceleration guide RF output graph 930 indicate that accelerator beam output is directly related to RF power provided to klystron 270*a*, and, in combination with the attenuation profile 730 for scenario 600, indicated that accelerator beam output is inversely related to attenuation levels specified in attenuation profile 730.

Figure 10:
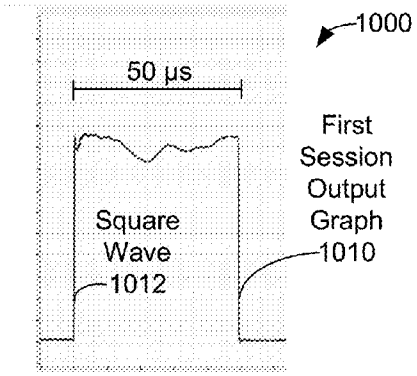
FIG. 10 depicts an output graph for first session of a scenario utilizing the particle accelerator of FIG. 2, in accordance with an example embodiment.

FIG. 10 depicts first session output graph 1010 for scenario 1000 utilizing particle accelerator 200, in accordance with an example embodiment. In scenario 1000, two sessions for using particle accelerator 200 take place. During the first session, timing controls are provided to the particle accelerator 200 to generate a 50 μs output. During the second session, the same timing controls are provided to the particle accelerator 200 as in the first session, but an attenuation profile, shown in FIG. 11 as attenuation profile 1120, is provided to particle accelerator 200 as well. The resulting 50 μs output of the second session differs from the 50 μs output of the second session as indicated by comparing second session output graph 1230 (shown in FIG. 12) with first session output graph 1010 (shown in FIG. 10).

First session output graph 1010 of FIG. 10 shows a constant-amplitude square wave 1012 having a pulse duration of 50 μs. Constant-amplitude square wave 1012 was produced during the first session of scenario 1000. Note that no attenuation profile was used in the first session, and thus no attenuation profile was used to generate first session output graph 1010. Rather; the slight imperfections in the middle of square wave 1012 are due to imperfections in particle accelerator 200.

Figure 11:
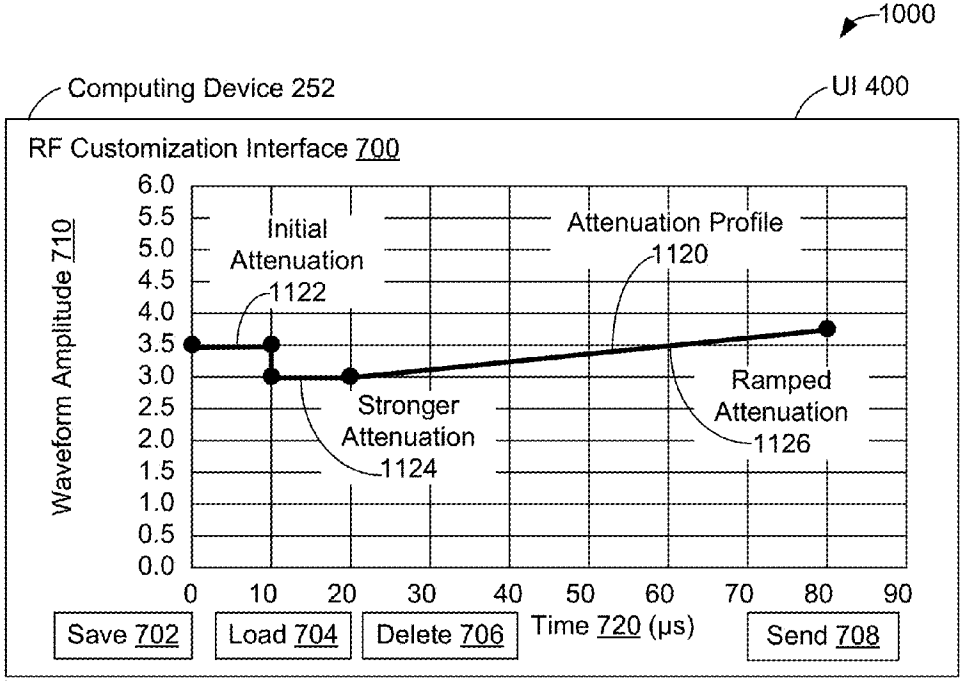
FIG. 11 depicts an RF customization interface of a user interface used in the scenario of FIG. 10, in accordance with an example embodiment.

FIG. 11 depicts RF customization interface 700 of user interface 400 used in scenario 1000, in accordance with an example embodiment. In scenario 1000, RF customization interface 700 is used to generate attenuation profile 1120. Attenuation profile 1120 indicates that the RF input to particle accelerator 200 is to be subject to: (i) a mild initial attenuation 1122 corresponding to a waveform amplitude of 3.5 for an initial 10 μs of the RF input duration; (ii) stronger attenuation 1124 corresponding to a waveform amplitude of 3.0 between 10 μs and 20 μs of the RF input duration, and (iii) ramped attenuation 1126, indicating linearly decreasing attenuation starting at 20 μs until the end of the second session.

As such, attenuation profile 1120 can be used to generate accelerator output with two pulses: a relatively short first pulse 1232 for the initial 10 μs of the RF input duration and a relatively longer second pulse 1234 for the remainder of the RF input duration. Many other types of pulses can be output by particle accelerator 200 based on attenuation profiles generated using RF customization interface 700 as well; e.g., as discussed herein in the context of attenuation profiles 730 and 1310.

Figure 12:
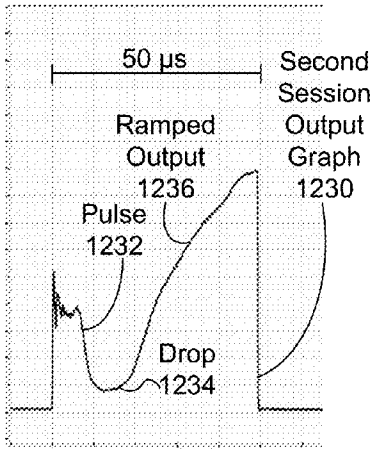
FIG. 12 depicts an accelerator beam output graph for the scenario of FIG. 10, in accordance with an example embodiment.

FIG. 12 depicts second session output graph 1230 for scenario 1000, in accordance with an example embodiment. During the second session of scenario 1000, attenuation profile 1120 is applied to the constant-amplitude RF produced by the RF generator 280, such as discussed above in the context of FIG. 7. Second session output graph 1230 shows that the output generated by particle accelerator 200 during the 50 μs of the second session includes (a) pulse 1232, which shows initially reduced output in comparison to first session output graph 1010, (b) drop 1234, indicating further reduced output for an interval of time, and (c) ramped output 1236, which shows gradually increasing output during the remainder of the second session. That is, comparison of attenuation profile 1120 and second session output graph 1230 indicates that the output generated by particle accelerator 200 has been customized to form a pulse shape that corresponds to the shape of attenuation profile 1120; e.g, initial attenuation 1122 corresponds to pulse 1232, stronger attenuation 1124 corresponds to drop 1234, and ramped attenuation 1126 corresponds to ramped output 1236.

Figure 13:
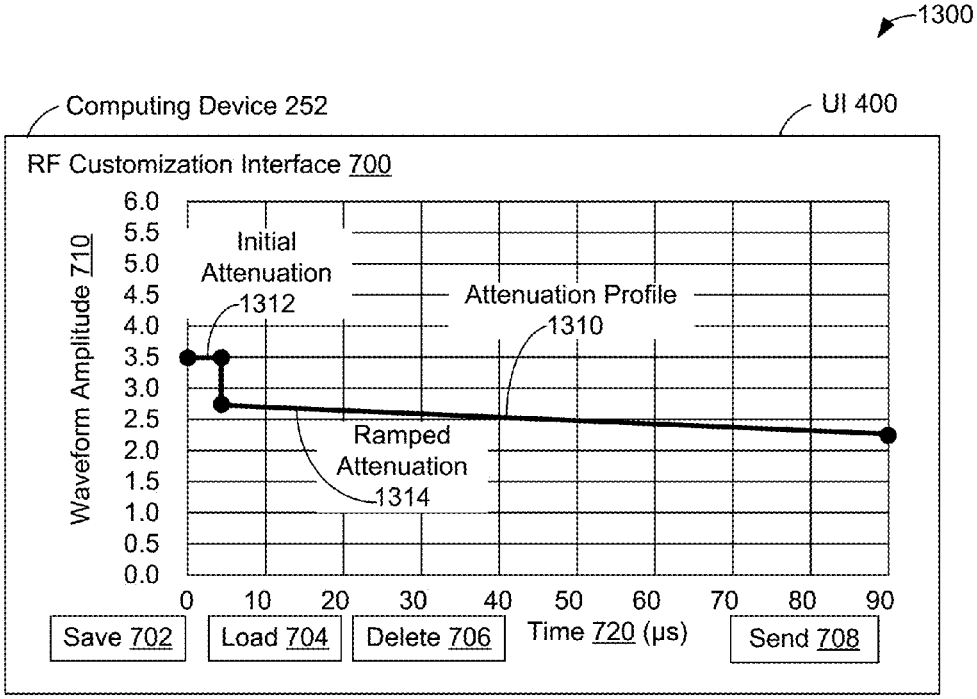
FIG. 13 depicts an RF customization interface of a user interface related to yet another scenario utilizing the particle accelerator of FIG. 2 in accordance with an example embodiment.

FIG. 13 depicts RF customization interface 700 used in scenario 1300 utilizing particle accelerator 200 in accordance with an example embodiment. In scenario 1300, one session for using particle accelerator 200 takes place where timing controls are provided to the particle accelerator 200 to generate a 50 μs output. During the session of scenario 1300, an attenuation profile, shown in FIG. 13 as attenuation profile 1310, is provided to the particle accelerator 200 as well.

In scenario 1300, RF customization interface 700 is used to generate attenuation profile 1310. FIG. 13 shows attenuation profile 1310, which indicates that the RF input to particle accelerator 200 is to be subject to: (i) mild initial attenuation 1312 for the first 5 μs of the RF input duration; and (ii) initially stronger and then linearly increasing/ramped attenuation 1314 starting at 5 μs until the end of the session of scenario 1300.

Figure 14:
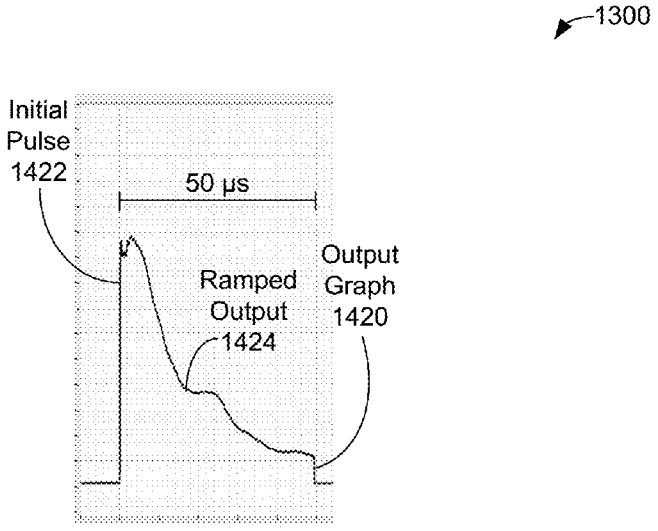
FIG. 14 depicts an accelerator beam output graph for the scenario of FIG. 13, in accordance with an example embodiment.

FIG. 14 depicts accelerator beam output graph 1420 for scenario 1300, in accordance with an example embodiment. During the session of scenario 1300, attenuation profile 1310 is applied to the constant-amplitude RF produced by the RF generator 280, such as discussed above in the context of FIG. 7. Output graph 1420 shows the output generated by particle accelerator 200 during the 50 μs session of scenario 1300 includes: (a) initial pulse 1422, which is relatively strong and then (b) ramped output 1424, which decreases initially relatively quickly and then relatively gradually until reaching a minimum output at the end of the session. Comparison of attenuation profile 1410 and output graph 1420 indicates that the output generated by particle accelerator 200 has been customized to form a pulse with a pulse shape that corresponds to the shape of attenuation profile 1310; e.g, initial attenuation 1312 corresponds to initial pulse 1422 and ramped attenuation 1314 corresponds to ramped output 1424.

FIG. 15 is a circuit diagram for switchable pulse forming network 284*a*, 284*b*, in accordance with an example embodiment. Switchable pulse forming network 284*a*, 284*b* includes a number of capacitors and inductors for storing electrical energy, switches 1510, 1520, and thyratron 1530. The capacitors and inductors shown in FIG. 15 are arranged as 35 stages or capacitor-inductor pairs shown in FIG. 15 as stages 1512*a*-1512*y* and 1542*a*-1542*j*. In other embodiments, more, fewer, and/or different stages of switchable pulse forming network 284*a*, 284*b* are possible as well.

Switches 1510 and 1520 can be controlled to have at least two settings: an enabled setting and a disabled setting. In other embodiments, more, fewer, and/or different numbers of switches can be provided as part of switchable pulse forming network 284*a*, 284*b*. For example, in applications where more variability in pulse duration is required, additional switches can be placed at various points in switchable pulse forming network 284*a*, 284*b*. In particular embodiments, a maximum number of switch arrangements can be one less than the number of stages in a pulse forming network. For a particular example, all but one of the thirty-five stages of switchable pulse forming network 284*a*, 284*b* shown in FIG. 15 could include a switch pair. In this example, switchable pulse forming network 284*a*, 284*b* would have thirty-four total switch pairs, with each switch pair enabling/disabling one stage, resulting in thirty-five different possible pulse durations. In still other embodiments, some or all of the switches in switchable pulse forming network 284*a*, 284*b* can be controlled remotely; e.g., computing device 252 can be used to control switch 1510 and/or switch 1520.

Thyratron 1530 can be a high-powered electrical switch and controlled rectifier. Thyratrons are discussed above in more detail in the context of FIG. 2.

A portion of switchable pulse forming network 284*a*, 284*b*, shown in FIG. 15 as partial pulse forming network 1540 having stages 1542*a*-1542*g*, can be controlled in part by use of switches 1510 and 1520. When switches 1510 and 1520 are both disabled, all of switched pulse forming network 284*a*, 284*b* is charged through PFN charge line voltage 1550 and discharges onto thyratron 1530. When switches 1510 and 1520 are both enabled, only partial pulse forming network 1540 is charged through PFN charge line voltage 1550. That is, while the switches 1510 and 1520 are both enabled, the (majority of) stages of switchable pulse forming network 284*a*, 284*b* that are not in partial pulse forming network 1540 are not changed. Then, the reduced number of charged stages of the partial pulse forming network 1540 (in comparison with all stages of switchable pulse forming network 284*a*, 284*b*) results in a smaller pulse width compared with the pulse provided by the entire pulse forming network 284*a*, 284*b*.

The use of switches 1510, 1520 can be used to adjust pulse duration to better match accelerator output pulse width. As pulse duration of switchable pulse forming network 284*a*, 284*b* can be adjusted to better match accelerator output pulse width, less electrical stress is placed on klystrons 270*a*, 270*b* (via thyratron 1530). By placing less electrical stress on klystrons 270*a*, 270*b*, the longevity of klystrons 270*a*, 270*b* can be increased and maintenance time for particle accelerator 200 can be decreased.

Figure 16:
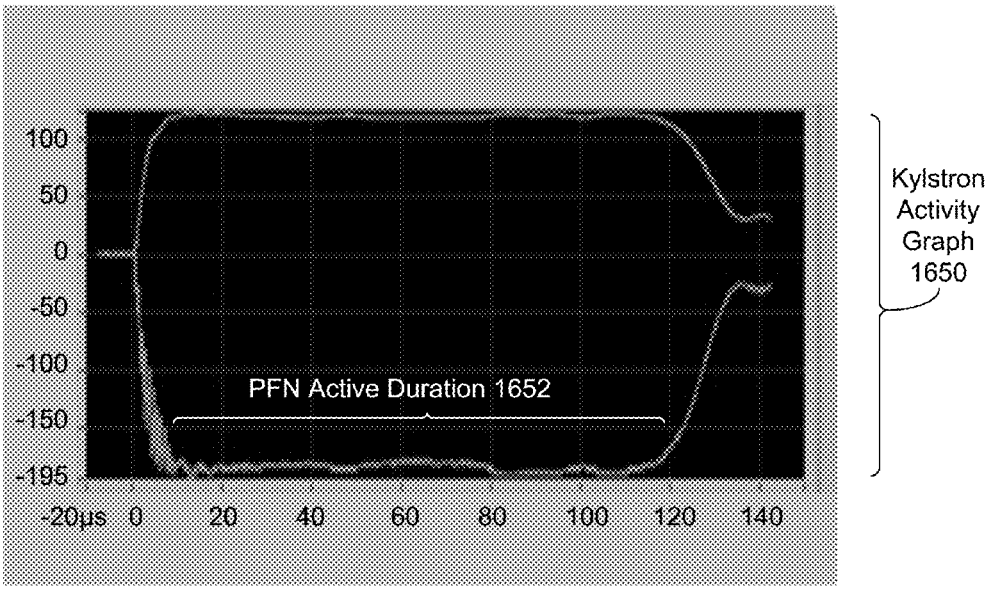
FIG. 16 depicts a klystron activity graph based on one setting of the switchable pulse forming network of FIG. 15, in accordance with an example embodiment.

FIG. 16 depicts a klystron activity graph 1650 based on one setting of switchable pulse forming network 284*a*, 284*b* shown in FIG. 15, in accordance with an example embodiment. During the session of using particle accelerator 200 recorded using graph 1650, both switches 1510, 1520 were disabled and so the entire switchable pulse forming network 284*a*, 284*b* was charged and discharged for this session. The resulting pulse forming network active duration 1652 is shown in FIG. 16 as being between about 15 μs and about 115 μs after the beginning of the session as indicated by the X-axis of graph 1650. That is, pulse forming network active duration 1652 indicates that switchable pulse forming network 284*a*, 284*b* was discharging, and so creating a pulse of energy for about 100 μs during the session.

Figure 17:
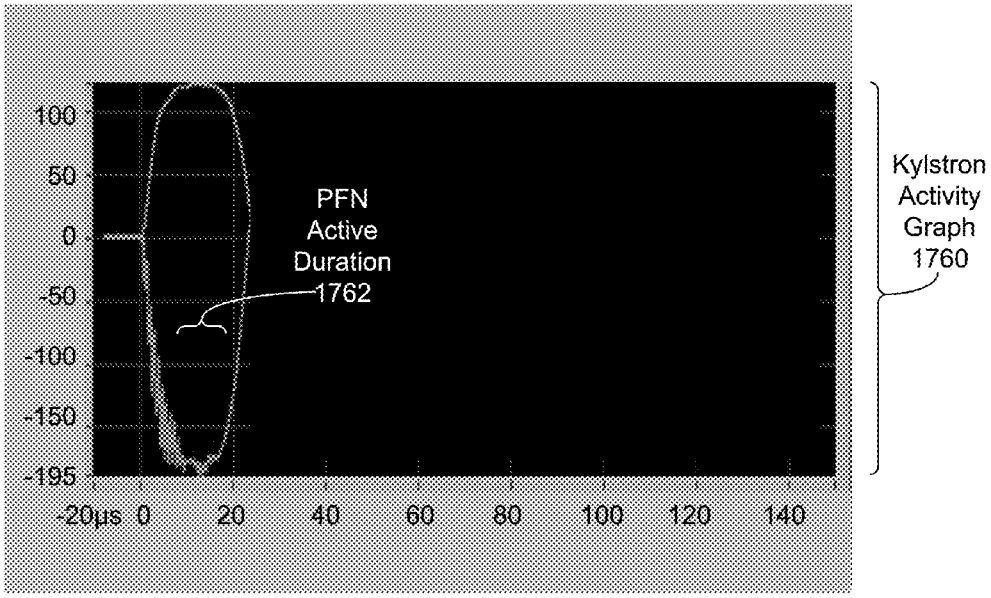
FIG. 17 depicts a klystron activity graph based on another setting of the switchable pulse forming network of FIG. 15, in accordance with an example embodiment.

FIG. 17 depicts a klystron activity graph 1760 based on another setting of switchable pulse forming network 284*a*, 284*b* shown in FIG. 15, in accordance with an example embodiment. During the session of using particle accelerator 200 recorded using graph 1760, both switches 1510, 1520 were enabled and so only partial switchable pulse forming network 1540 was charged and discharged for this session. The resulting pulse forming network active duration 1762 is shown in FIG. 17 as being between about 9 μs and about 19 μs after the beginning of the session as indicated by the X-axis of graph 1760. That is, pulse forming network active duration 1762 indicates that partial switchable pulse forming network 1540 was discharging, and so creating a pulse of energy for about 10 μs during the session.

Example Computing Device

FIG. 18 is a block diagram of a computing device 1800, in accordance with an example embodiment. Computing device 1800 can include user interface module 1801, network-communication interface module 1802, one or more computer processors 1803, and data storage 1804, all of which may be linked together via a system bus, network, or other connection mechanism 1805, in accordance with an example embodiment. In particular, computing device 1800 can be configured to perform one or more functions related to: computing device 252, RF control software 254, user interface 400, timing control interface 410, RF customization interface 700, attenuation profiles 730, 1120, 1310, switches 1510, 1520, one or more sessions where particle accelerator 200 is used, generation and/or display of graphs 330, 510, 520, 530, 630, 840, 910, 920, 930, 1010, 1230, 1420, 1650, 1760, and/or to implement at least part of scenarios 300, 600, 1000, 1300 and/or method 100. In some embodiments, computing device 1800 can be a mobile or non-mobile computing device, and can be embodied as one or more of: desktop computer, laptop or notebook computer, personal data assistant (PDA), mobile phone, smart phone, smart watch, embedded processor, and/or any similar device that is equipped with at least one processing unit capable of executing machine-language instructions that implement at least part of the herein-described techniques and methods, including but not limited to scenarios 300, 600, 1000, 1300, and/or method 100 described in more detail above with respect to FIG. 1.

User interface 1801 can receive input and/or provide output, perhaps to a user. User interface 1801 can be configured to send and/or receive data to and/or from user input from input device(s), such as a keyboard, a keypad, a touch screen, a touch pad, a computer mouse, a track ball, a joystick, a game controller, and/or other similar devices configured to receive user input from a user of the computing device 1800. User interface 1801 can include output display devices, which can include, but are not limited to, one or more: cathode ray tubes (CRTs), liquid crystal displays (LCDs), light emitting diodes (LEDs), displays using digital light processing (DLP) technology, printers, light bulbs, and/or other devices capable of displaying visual outputs (e.g., graphical, textual, and/or numerical information). User interface module 1801 can also be configured with one or more devices to generate audible output(s), such as a speaker, speaker jack, audio output port, audio output device, earphones, and/or other similar devices configured to convey sound and/or audible information to a user of computing device 1800.

Network-communication interface module 1802 can be configured to send and receive data over wireless interfaces 1807 and/or wired interfaces 1808 via a network. Wireless interface(s) 1807 if present, can utilize an air interface, such as a Bluetooth®, ZigBee®, Wi-Fi, and/or WiMAX interface to a data network, such as a wide area network (WAN), a local area network (LAN), one or more public data networks (e.g., the Internet), one or more private data networks, or any combination of public and private data networks. Wired interface(s) 1808, if present, can comprise a wire, cable, fiber-optic link and/or similar physical connection to a data network, such as a WAN, a LAN, one or more public data networks, such as the Internet, one or more private data networks, or any combination of such networks.

In some embodiments, network-communication interface module 1802 can be configured to provide reliable, secured, and/or authenticated communications. For each communication described herein, information for ensuring reliable communications (i.e., guaranteed message delivery) can be provided, perhaps as part of a message header and/or footer (e.g., packet/message sequencing information, encapsulation header(s) and/or footer(s), size/time information, and transmission verification information such as CRC and/or parity check values). Communications can be made secure (e.g., be encoded or encrypted) and/or decrypted/decoded using one or more cryptographic protocols and/or algorithms, such as, but not limited to, DES, AES, RSA, Diffie-Hellman, and/or DSA. Other cryptographic protocols and/or algorithms can be used as well as or in addition to those listed herein to secure (and then decrypt/decode) communications.

Computer processor(s) 1803 can include one or more central processing units, computer processors, mobile processors, digital signal processors (DSPs), GPUs, microprocessors, computer chips, programmable processors, multicore processors, and/or other processing units configured to execute machine-language instructions and process data. Processor(s) 1803 can be configured to execute computer-readable program instructions 1806 that are contained in data storage 1804 and/or other instructions as described herein.

Data storage 1804 can include one or more physical and/or non-transitory storage devices, such as read-only memory (ROM), random access memory (RAM), removable disk drives, hard drives, thumb drives, magnetic-tape memory, optical-disk memory, flash memory, volatile storage devices, non-volatile storage devices, and/or other storage devices. Generally, a storage device is hardware that is capable of storing information; for example, data, computer-readable program instructions, and/or other suitable information on a temporary basis and/or a permanent basis. Data storage 1804 can include one or more physical and/or non-transitory storage devices with at least enough combined storage capacity to contain computer-readable program instructions 1806 and any associated/related data structures. In some embodiments, some or all of data storage 1804 can be removable, such as a removable hard drive, removable disk, or flash memory.

Computer-readable program instructions 1806 and any data structures contained in data storage 1804 include computer-readable program instructions executable by processor (s) 1803 and any storage required, respectively, to perform at least part of herein-described scenarios and methods, including but not limited to scenarios 300, 600, 1000, 1300, and/or method 100. Computer-readable program instructions 1806 can include instructions that when executed by processor(s) 1803 to perform functions, including but not limited to herein-described functionality of software, displays, and/or user interfaces. In some embodiments, computer-readable program instructions 1806 can include some or all computer-readable program instructions for RF control software (S/W) 254.

Other components shown in FIG. 18 can be varied from the illustrative examples shown. Generally, the different embodiments can be implemented using any hardware device or system capable of running program code.

Disclosed embodiments are described above with reference to the accompanying drawings, in which some, but not all of the disclosed embodiments may be shown. Indeed, several different embodiments may be described and should not be construed as limited to the embodiments set forth herein. Rather, these embodiments are described so that this disclosure are thorough and complete and convey the disclosure at least to those skilled in the art.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent from the foregoing descriptions. Such modifications and variations are intended to fall within the scope of the appended claims.

It should be understood that for the processes and methods disclosed herein, flowcharts show functionality and operation of possible implementations of respective embodiments. In this regard, each block may represent a module, a segment, or a portion of program code, which includes one or more instructions executable by a processor for implementing specific logical functions or steps in the process. The program code may be stored on any type of computer readable medium or data storage, for example, such as a storage device including a disk or hard drive. The computer readable medium may include non-transitory computer readable medium or memory, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a tangible computer readable storage medium, for example.

In addition, each block in the disclosed flowcharts may represent circuitry that is wired to perform the specific logical functions in the process. Alternative implementations are included within the scope of the example embodiments of the present disclosure in which functions may be executed out of order from that shown or discussed, including substantially concurrent or in reverse order, depending on the functionality involved, as would be understood by those reasonably skilled in the art.

The description of the different advantageous arrangements has been presented for purposes of illustration and description, and is not intended to be exhaustive or limited to the embodiments in the form disclosed. Many modifications and variations will be apparent to those of ordinary skill in the art. Further, different advantageous embodiments may describe different advantages as compared to other advantageous embodiments. The embodiment or embodiments selected are chosen and described in order to explain the principles of the embodiments, the practical application, and to enable others of ordinary skill in the art to understand the disclosure for various embodiments with various modifications as are suited to the particular use contemplated.

The invention claimed is:

1. A method for generating an amplified pulsed radio frequency (RF) signal, comprising:

generating an attenuation profile for a particle accelerator;

determining a waveform and a duration for a pulsed RF signal based on the attenuation profile using the particle accelerator;

generating the pulsed RF signal having the waveform and the duration using the particle accelerator; and generating an amplified pulsed RF signal using one or more amplifiers of the particle accelerator, wherein the one or more amplifiers comprise a pulse forming network (PFN), wherein the PFN comprises a plurality of stages and a plurality of PFN switches, wherein a PFN stage of the plurality of PFN stages comprises one or more capacitors and one or more inductors, and wherein the plurality of PFN switches controls the plurality of PFN stages, and wherein the duration of the amplified pulsed RF signal is based on one or more settings of the plurality of PFN switches.

2. The method of claim 1, wherein the particle accelerator comprises an accelerating guide, and wherein the method further comprises:

controlling one or more charged particles traveling along the accelerating guide using the amplified pulsed RF signal.

3. The method of claim 1, wherein the particle accelerator further comprises an arbitrary waveform generator (ARB), and wherein determining the waveform and the duration for the pulsed RF signal based on an attenuation profile comprises determining the waveform and the duration for the pulsed RF signal using the ARB.

4. The method of claim 3, wherein determining the waveform and the duration for the pulsed RF signal using the ARB comprises determining one or more amplitudes of the pulsed RF signal using the ARB.

5. The method of claim 1, further comprising:

generating an output of the particle accelerator based on the amplified pulsed RF signal, wherein the output comprising a plurality of pulses with each pulse having a pulse duration.

6. The method of claim 5, wherein the output of the particle accelerator comprises a first pulse and a second pulse, wherein the pulse duration of the first pulse is relatively short, and wherein the pulse duration of the second pulse is relatively long.

7. The method of claim 1, wherein the particle accelerator comprises an RF generator and a voltage attenuator, and wherein generating the amplified pulsed RF signal using one or more amplifiers of the particle accelerator comprises:

generating a constant amplitude waveform using the RF generator;

generating the pulsed RF signal by attenuating the constant amplitude waveform according to the waveform and the duration using the voltage attenuator; and providing the pulsed RF signal as an input to the one or more amplifiers using the voltage attenuator.

8. The method of claim 1, wherein the particle accelerator comprises a linear accelerator.

9. A particle accelerator, comprising:

one or more computer processors; and data storage, storing instructions that, upon execution by the one or more computer processors, cause the particle accelerator to perform functions that include:

generating an attenuation profile;

an arbitrary waveform generator (ARB) for:

determining a waveform and a duration for a pulsed radio frequency (RF) signal based on the attenuation profile; and generating the pulsed RF signal having the waveform and the duration; and one or more amplifiers, comprising a pulse forming network (PFN), wherein the PFN comprises:

a plurality of PFN stages, wherein a PFN stage of the plurality of PFN stages comprises one or more capacitors and one or more inductors, and a plurality of PFN switches for controlling the plurality of PFN stages, wherein the PFN is for:

generating an amplified pulsed RF signal based on the pulsed RF signal, wherein the duration of the amplified pulsed RF signal is based on one or more settings of the plurality of PFN switches.

10. The particle accelerator of claim 9, further comprising an accelerating guide, wherein the amplified pulsed RF signal is used to control one or more charged particles traveling along the accelerating guide.

11. The particle accelerator of claim 9, wherein the particle accelerator comprises a plurality of stages, wherein the plurality of stages are configured to utilize the amplified pulsed RF signal concurrently, and wherein each stage of the plurality of stages comprises an ARB and an PFN.

12. The particle accelerator of claim 11, wherein providing the pulsed RF signal as an input to the one or more amplifiers comprises providing the pulsed RF signal to each stage of the particle accelerator.

13. The particle accelerator of claim 9, wherein the attenuation profile specifies the waveform and the duration.

14. The particle accelerator of claim 9, wherein determining the waveform and the duration for the pulsed RF signal comprises determining one or more amplitudes of the pulsed RF signal.

15. The particle accelerator of claim 9, wherein the particle accelerator generates an output based on the amplified pulsed RF signal, and wherein the output comprises a plurality of pulses with each pulse having a pulse duration.

16. The particle accelerator of claim 15, wherein the output comprises a first pulse and a second pulse, wherein the pulse duration of the first pulse is relatively short, and wherein the pulse duration of the second pulse is relatively long.

17. The particle accelerator of claim 9, wherein the particle accelerator further comprises:

an RF generator for generating a constant amplitude waveform; and a voltage attenuator for:

generating the pulsed RF signal by attenuating the constant amplitude waveform according to the waveform and the duration using the voltage attenuator; and providing the pulsed RF signal as an input to the one or more amplifiers.

18. The particle accelerator of claim 9, wherein the functions for generating the attenuation profile comprise functions for:

receiving a specification of the attenuation profile; and providing the attenuation profile to the ARB.

19. The particle accelerator of claim 9, wherein the functions further include:

controlling the one or more settings of the plurality of PFN switches.

20. The particle accelerator of claim 9, wherein the particle accelerator comprises a linear accelerator.

* * * * *